US009703216B2

(12) United States Patent
Tsuchida et al.

(10) Patent No.: US 9,703,216 B2
(45) Date of Patent: Jul. 11, 2017

(54) TONER USING SMALL-PARTICLE SIZE MAGNETIC IRON OXIDE

(71) Applicant: CANON KABUSHIKI KAISHA, Tokyo (JP)

(72) Inventors: Naohiko Tsuchida, Abiko (JP); Wakashi Iida, Toride (JP); Yoshihiro Ogawa, Toride (JP); Toru Takahashi, Abiko (JP); Daisuke Tsujimoto, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/326,176

(22) Filed: Jul. 8, 2014

(65) Prior Publication Data

US 2015/0017581 A1 Jan. 15, 2015

(30) Foreign Application Priority Data

Jul. 12, 2013 (JP) ..... 2013-146596

(51) Int. Cl.
*G03G 9/083* (2006.01)

(52) U.S. Cl.
CPC ..... *G03G 9/0833* (2013.01); *G03G 9/0831* (2013.01); *G03G 9/0835* (2013.01); *G03G 9/0836* (2013.01); *G03G 9/0837* (2013.01); *G03G 9/0838* (2013.01)

(58) Field of Classification Search
CPC .. G03G 9/0833; G03G 9/0837; G03G 9/0831; G03G 9/0838; G03G 9/0836; G03G 9/0835
USPC ..... 430/106.2
See application file for complete search history.

(56) References Cited

U.S. PATENT DOCUMENTS

| | | | | |
|---|---|---|---|---|
| 5,750,302 | A | 5/1998 | Ogawa et al. | |
| 5,858,593 | A | 1/1999 | Tamura et al. | |
| 6,238,834 | B1 | 5/2001 | Tamura et al. | |
| 6,280,649 | B1 | 8/2001 | Meisen | |
| 7,597,958 | B2 | 10/2009 | Uemoto et al. | |
| 2002/0168523 | A1* | 11/2002 | Uchida | G03G 9/0831 428/403 |
| 2005/0026065 | A1* | 2/2005 | Onuma | G03G 9/0817 430/110.3 |
| 2012/0064449 | A1* | 3/2012 | Iwai | B82Y 30/00 430/106.2 |

FOREIGN PATENT DOCUMENTS

| | | | |
|---|---|---|---|
| EP | 1 048 619 | A1 | 11/2000 |
| EP | 1 849 839 | A2 | 10/2007 |
| EP | 1 961 704 | A1 | 8/2008 |
| JP | 6-118700 | A | 4/1994 |
| JP | 2008-230960 | A | 10/2008 |
| JP | 2009-205047 | A | 9/2009 |
| WO | 2011/152434 | A1 | 12/2011 |

OTHER PUBLICATIONS

European Search Report dated Nov. 27, 2014 in European Application No. 14176485.2.

* cited by examiner

*Primary Examiner* — Thorl Chea
(74) *Attorney, Agent, or Firm* — Fitzpatrick, Cella, Harper & Scinto

(57) ABSTRACT

Provided is a magnetic toner which exhibits a high degree of blackness and high tinting strength, and in which scraping of a toner carrying member surface by the magnetic toner is not caused, and image defects such as fogging and tailing are suppressed. A magnetic toner comprising a magnetic toner particle that contains a binder resin and a magnetic iron oxide particle, wherein, the number-average particle diameter of the magnetic iron oxide particle ranges from 0.05 μm to 0.15 μm, and a relationship between the number-average particle diameter (μm) of the magnetic iron oxide particle and the specific surface area ($m^2/g$) of the magnetic iron oxide particle satisfies Expression (1) below.

$$[\text{Number-average particle diameter}]\times[\text{specific surface area}]\leq 1.10 \quad (1).$$

7 Claims, No Drawings

TONER USING SMALL-PARTICLE SIZE MAGNETIC IRON OXIDE

BACKGROUND OF THE INVENTION

Field of the Invention

The present invention relates to a magnetic toner that is used in a recording method that relies on electrophotography, electrostatic recording or magnetic toner jetting.

Description of the Related Art

Developments in image-forming apparatuses such as copiers and printers in recent years have placed greater demands on toner, in terms of coping with higher speeds, better image quality and higher reliability, at or above the level of conventional image-forming apparatuses. As the environments in which toner is used have become more diverse, toner is furthermore required to afford stable images also when used in such various environments.

Meanwhile, one-component development schemes are preferably used as development schemes in such image-forming systems, since one-component development is little problematic, and boasts long service life and easy maintenance, and can therefore be used in a developing device of simple structure.

Such one-component development schemes include various known methods. One such method is jumping development relying on magnetic toner wherein a magnetic iron oxide is encapsulated in the toner. Jumping development is a method that involves causing a magnetic toner charged through triboelectric charging with a toner carrying member to fly onto and become adhered to a photosensitive member, on account of a developing bias, and developing thereupon the electrostatic image on the photosensitive member in the form of a magnetic toner image. Jumping development is widely used in practice thanks to the ease with which transport of the magnetic toner is controlled, and thanks to the low degree of internal contamination that jumping development generates in a copier, printer or the like.

Several methods have been proposed in the past for obtaining stable images through the use of magnetic toner of high degree of blackness.

Japanese Patent Application Publication No. H06-118700 discloses a feature of prescribing a ratio between the dielectric loss tangent of toner at a high-temperature region and at a normal-temperature region, and using a colorant of high degree of blackness, to reduce thereby changes in the charging performance of toner caused by the environment, and maintain as a result high degree of blackness also in a halftone image, regardless of the environment.

Japanese Patent Application Publication No. 2009-205047 discloses a toner in which the surface of a toner carrying member exhibits no contamination, even upon printing over long periods of time, through control of the particle size distribution of the toner and of uneven portions at the toner carrying member surface.

Japanese Patent Application Publication No. 2008-230960 discloses a method of producing a magnetic iron oxide of high degree of blackness, through control of a sulfur component within the magnetic iron oxide, and discloses a magnetic toner of good tinge that comprises the above magnetic iron oxide.

SUMMARY OF THE INVENTION

From the viewpoint of reducing running costs, magnetic toner is required to exhibit yet better tinting strength, so as to enable printing with high degree of blackness even with small amounts of magnetic toner. The tinting strength of magnetic toner is significantly influenced by the performance of the magnetic iron oxide that is comprised in the magnetic toner. Briefly, the tinting strength of the magnetic toner increases if the content of magnetic iron oxide in the magnetic toner is increased, but this tends to have a significant impact on image quality. The inventors of the present application focused on reducing the particle diameter of the magnetic iron oxide, to enable thereby increasing the number of particles magnetic iron oxide comprised in magnetic toner, and make it possible to increase the tinting strength of the magnetic toner, also when using a same weight of a magnetic iron oxide. The extent to which paper is hidden by the magnetic iron oxide in the magnetic toner increases, and accordingly the tinting strength of the magnetic toner becomes greater, as the particles of the magnetic iron oxide, as a colorant, are present in greater numbers.

However, reducing the particle diameter of the magnetic iron oxide gives rise to new problems. One such problem, for instance, is a drop of the degree of blackness of the magnetic iron oxide itself. This problem arises in that the surface area per unit weight increases on account of the particle diameter reduction of the magnetic iron oxide, and, in consequence, there increases the specific surface area of the magnetic iron oxide as a whole. The surface of a magnetic iron oxide having a large specific surface area is oxidized readily. Surface-oxidized magnetic iron oxide exhibits a reddish tinge. As a result, the degree of blackness of the magnetic toner comprising such a magnetic iron oxide drops, and the magnetic toner no longer delivers quality black. Thus, simply reducing the particle diameter of magnetic iron oxide in order to enhance the tinting strength of the magnetic toner entails the problem of impaired tinge.

Other problems that arise when the specific surface area of the magnetic iron oxide is increased include, for instance, scraping of the toner carrying member surface by the magnetic toner that comprises the magnetic iron oxide. This problem arises because a magnetic iron oxide of large specific surface area exhibits greater surface unevenness, and the toner carrying member is scraped, on account of the unevenness of the surface of the magnetic iron oxide that is exposed at the magnetic toner surface, when the magnetic toner comprising such a magnetic iron oxide and the toner carrying member come into contact with each other. The magnetic toner is imparted with charging performance, through triboelectric charging, by coming into contact with the toner carrying member surface; accordingly, scraping of the surface of the toner carrying member translates into insufficient triboelectric charging of the magnetic toner, and in the occurrence of image defects such as white streak-like lines in solid black images. The extent of scraping of the toner carrying member surface is not problematic in cases where a conventional magnetic iron oxide is used. When using a magnetic iron oxide of larger specific surface area as a result of particle diameter reduction, however, there increases scraping of the toner carrying member surface derived from the unevenness of the magnetic iron oxide surface, and image defects occur as a result.

Fogging is yet another problem derived from an increased specific surface area of the magnetic iron oxide. Fogging occurs when magnetic toner of low charge amount flies onto, and becomes adhered to, a non-latent image portion on the photosensitive member. The magnetic iron oxide exposed at the magnetic toner surface constitutes leakage points of the charge of the magnetic toner. Leakage of charge through the magnetic iron oxide occurs more readily as the specific surface area of the magnetic iron oxide increases and unevenness becomes greater. The surface area of magnetic iron oxide that is exposed at the magnetic toner surface increases when using, in the magnetic toner, a magnetic iron oxide having a smaller than particle diameter and larger specific surface area than those of a conventional magnetic iron oxide. Accordingly, the charge amount of the magnetic toner drops on account of charge leaks, and fogging worsens as a result.

The issue of tailing needs to be taken into consideration as well. Tailing is a phenomenon wherein magnetic toner juts beyond an electrostatic latent image section on the photosensitive member, downstream in the rotation direction of the photosensitive member. If a magnetic iron oxide of large specific surface area is used in the magnetic toner as described above, the specific surface area of the magnetic iron oxide that is exposed at the magnetic toner surface increases, and unevenness increases, as described above; as a result, the charge amount of the magnetic toner tends to decrease on account of charge leakage. When the charge amount of magnetic toner decreases, the electrostatic repulsion between magnetic toner particles becomes weaker, and magnetic toner particles coalesce with each other to form aggregates. When such aggregates fly onto and adhere to the photosensitive member, the aggregated magnetic toner protrudes out of the electrostatic latent image section, and tailing is likely to occur as a result.

None of the above citations addresses the issues of toner carrying member scraping, or image defects such as fogging and tailing, derived from the magnetic iron oxide, that arise upon reduction of the particle diameter of the magnetic iron oxide in the magnetic toner.

It is an object of the present invention to provide a magnetic toner in which the above problems are solved.

Specifically, it is an object of the present invention to provide a magnetic toner of high degree of blackness and high tinting strength, and in which scraping of a toner carrying member surface caused by the magnetic toner does not occur, and image defects such as fogging and tailing are suppressed.

In order to provide a magnetic toner of high degree of blackness and high tinting strength, and in which scraping of a toner carrying member surface caused by the magnetic toner does not occur, and image defects such as fogging and tailing are suppressed, the inventors of the present application investigated an approach, in a jumping development method, whereby a magnetic toner that elicits the above effect can be obtained by smoothing the surface of a magnetic iron oxide of reduced particle diameter and that is comprised in magnetic toner. Herein, the smoothness of the magnetic body surface can be expressed as the specific surface area thereof. For instance, given two particles of identical particle diameter and mass but dissimilar specific surface area, the particle of smaller specific surface area is deemed to have a smoother surface. As described above, a relationship holds wherein simply reducing the particle diameter of the magnetic iron oxide results in a larger specific surface area. In order to achieve a magnetic iron oxide having both a small particle diameter and surface smoothness it is necessary to control not the property values of particle diameter and surface area on their own, but to control simultaneously the property values of particle diameter and specific surface area of the magnetic iron oxide. Such being the case, the inventors of the present application found that the sought after effect is elicited, in a magnetic toner that has a magnetic toner particle containing a binder resin and a magnetic iron oxide, by controlling simultaneously the number-average particle diameter and specific surface area of the magnetic iron oxide, and by controlling the number-average particle diameter of the magnetic iron oxide as well as the value of the product of the number-average particle diameter and the specific surface area of the magnetic iron oxide so as to lie within a certain range.

Specifically, the present invention is a magnetic toner comprising a magnetic toner particle that contains a binder resin and a magnetic iron oxide particle, wherein the magnetic iron oxide particle has the number-average particle diameter ranging from 0.05 μm to 0.15 μm, and a relationship between the number-average particle diameter (μm) of the magnetic iron oxide particle and the specific surface area ($m^2/g$) of the magnetic iron oxide particle satisfies Expression (1) below.

$$[\text{number-average particle diameter } (\mu m)]\times[\text{specific surface area } (m^2/g)]\leq 1.10(\mu m\cdot m^2/g) \quad (1)$$

The present invention succeeds in providing a magnetic toner of high degree of blackness and high tinting strength, and in which scraping of a toner carrying member surface caused by the magnetic toner does not occur, and image defects such as fogging and tailing are suppressed.

Further features of the present invention will become apparent from the following description of exemplary embodiments.

DESCRIPTION OF THE EMBODIMENTS

The magnetic toner of the present invention is a magnetic toner comprising a magnetic toner particle that contains a binder resin and a magnetic iron oxide particle, wherein the number-average particle diameter of the magnetic iron oxide particle ranges from 0.05 μm to 0.15 μm, and a relationship between the number-average particle diameter (μm) of the magnetic iron oxide particle and the specific surface area ($m^2/g$) of the magnetic iron oxide particle satisfies Expression (1) below.

$$[\text{number-average particle diameter } (\mu m)]\times[\text{specific surface area } (m^2/g)\leq]1.10(\mu m\cdot m^2/g) \quad (1)$$

Specifically, the effect of the present invention is elicited by controlling, to given values, the number-average particle diameter of the magnetic iron oxide particle, as well as the product of the number-average particle diameter and the specific surface area of the magnetic iron oxide particle.

The number-average particle diameter of the magnetic iron oxide particle in the magnetic toner of the present invention will be explained first.

The number-average particle diameter of the magnetic iron oxide particle of the present invention ranges from 0.05 μm to 0.15 μm, preferably from 0.10 μm to 0.14 μm. If the number-average particle diameter of the magnetic iron oxide particle lies within the above range, a magnetic toner of high degree of blackness and high tinting strength can be obtained, since in this case it is possible to secure a sufficient number of the magnetic iron oxide particle that functions as a colorant in the magnetic toner. If the number-average particle diameter of the magnetic iron oxide particle is greater than 0.15 μm, the number of particles of magnetic iron oxide in the magnetic toner decreases, and the tinting strength of the magnetic toner drops. If the number-average particle diameter of the magnetic iron oxide particle is smaller than 0.05 μm, the specific surface area of the magnetic iron oxide particle increases, and the magnetic iron oxide particle is readily oxidized, thereby acquiring a reddish character that accordingly impairs the degree of blackness of the magnetic toner.

The prominent effect of the present invention cannot be sufficiently achieved just by controlling only the number-average particle diameter of the magnetic iron oxide particle so as to lie within the above range. The inventors of the present application found that when using magnetic iron oxide particle having undergone particle diameter reduction, it is necessary to control the product of the number-average particle diameter and the specific surface area of the magnetic iron oxide particle, in conjunction with the number-average particle diameter of the magnetic iron oxide particle, in order to sufficiently bring out the effect of the present invention.

The reasons for this are explained in detail further on.

Ordinarily, the specific surface area of magnetic iron oxide particle increases as the number-average particle diameter of the magnetic iron oxide particle decreases. Thus, actual use of a magnetic toner in which such a magnetic iron oxide particle is utilized becomes difficult due to the occurrence of the various problems described above. The inventors of the present application found that the unevenness of the magnetic iron oxide particle surface causes scraping of the toner carrying member surface and gives rise to leakage points of charge of the magnetic toner; as a result, the charge amount of the magnetic toner decreases, and fogging and/or tailing occur. The inventors found also that if the specific surface area of the magnetic iron oxide particle is controlled to be small, it becomes possible to obtain a magnetic toner of high degree of blackness in which scraping of the toner carrying member surface can be suppressed, and the occurrence of fogging and tailing is suppressed, even for a magnetic iron oxide particle of reduced particle diameter. Herein, controlling the specific surface area of the magnetic iron oxide particle so as to be small is tantamount to smoothing the unevenness of the magnetic iron oxide surface.

Thus, the inventors of the present application found that the intended effect of the present invention can be sufficiently brought out by not only setting the number-average particle diameter of the magnetic iron oxide particle to lie within the above range, but also by controlling the surface of the magnetic iron oxide particle to be a smooth surface. Specifically, a magnetic toner that solves the above problems can be obtained by using a magnetic iron oxide particle having the number-average particle diameter and specific surface area that satisfy Expression (1).

The relationship between the number-average particle diameter and the specific surface area of the magnetic iron oxide particle of the present invention will be explained next.

The product of the number-average particle diameter (μm) and the specific surface area ($m^2/g$) of the magnetic iron oxide particle of the present invention is 1.10 ($\mu m \cdot m^2/g$) or smaller, preferably 1.00 ($\mu m \cdot m^2/g$) or smaller and more preferably 0.95 ($\mu m \cdot m^2/g$) or smaller. Preferably, the product of the number-average particle diameter and the specific surface area of the magnetic iron oxide particle is 0.60 ($\mu m \cdot m^2/g$) or greater. If the value of the product of the number-average particle diameter and the specific surface area of the magnetic iron oxide particle lies within the above ranges, a magnetic toner of high degree of blackness can be obtained in which scraping of the toner carrying member surface is suppressed, and in which fogging and tailing are inhibited. If the product of the number-average particle diameter and the specific surface area of the magnetic iron oxide particle is greater than 1.10 ($\mu m \cdot m^2/g$), the unevenness of the magnetic iron oxide particle surface increases, and the toner carrying member surface is scraped as a result by the magnetic toner. Also, there increases the surface area of the magnetic iron oxide particle within the magnetic toner surface, and there arise leakage points of charge of the magnetic toner, as a result of which the charge amount of the magnetic toner decreases and fogging and/or tailing occur.

An explanation follows next on means for obtaining a magnetic iron oxide particle, such as the magnetic iron oxide particle that is used in the present invention, of small particle diameter and having a smaller specific surface area than that of conventional magnetic iron oxide particles.

In Japanese Patent Application Publication No. 2008-230960, an ordinary single-stage oxidation reaction step in the production of a magnetic iron oxide particle is divided into two stages; thereby, crystals of the magnetic iron oxide are grown carefully, and a magnetic iron oxide particle is obtained that exhibits a smaller particle diameter while a high degree of blackness of the magnetic iron oxide particle is preserved. However, simply dividing production steps in this manner does not afford sufficient stirring of the magnetic iron oxide during reactions, so that a uniform oxidation reaction cannot be conducted. If the oxidation reaction during production of the magnetic iron oxide is not uniform, the growth of magnetic iron oxide crystals is likewise non-uniform, and a magnetic iron oxide particle of smooth surface cannot be obtained. As a result, the product of the number-average particle diameter and the specific surface area of the magnetic iron oxide particle is not 1.10 or smaller, and in consequence, scraping of the toner carrying member and image defects such as fogging and tailing occur when such a magnetic iron oxide particle is used. Other known methods include methods that involve blowing constantly high-concentration oxygen during the reaction step in the production of the magnetic iron oxide particle, to promote thereby the oxidation reaction at the magnetic iron oxide particle surface, and yield a magnetic iron oxide particle of high degree of blackness, even with a small particle diameter. Such methods, however, do not address the smoothness of the magnetic body surface, and hence a magnetic iron oxide particle cannot be obtained such that the product of the number-average particle diameter and the specific surface area of the magnetic iron oxide particle is 1.10 ($\mu m \cdot m^2/g$) or smaller.

In order to obtain a magnetic iron oxide particle such that the product of the number-average particle diameter and the specific surface area is 1.10 ($\mu m \cdot m^2/g$) or smaller it is necessary to grow crystals of the magnetic iron oxide particle carefully, and also to promote uniform crystal growth of the magnetic iron oxide particle. To that end, it is necessary to uniformize the growth of magnetic iron oxide particles through uniform mixing of a slurry-like solution that comprises the magnetic iron oxide, during the oxidation reaction.

Examples of methods to that end include, for instance, dividing the oxidation reaction step during production of the magnetic iron oxide particle, and further, adjusting the pH of a slurry-like solution that comprises the magnetic iron oxide particle. In this case, the viscosity of the solution drops, and hence stirring becomes easier, so that uniform stirring of the solution in that state allows crystal growth of the magnetic iron oxide particle to proceed uniformly. Also, crystal growth of the magnetic iron oxide particle in solution can be caused to proceed uniformly by discontinuing crystal growth of the magnetic iron oxide particle at one time, and by vigorously stirring thereupon the slurry-like solution using mechanical means.

A preferred method for producing the magnetic iron oxide particle of the present invention will be explained next, but the present invention is not limited to that method.

The magnetic iron oxide particle of the present invention can be obtained, for instance, as a result of performing:

a first reaction step of forming seed particles of the magnetic iron oxide;

a second reaction step of growing the seed particles; and a third reaction step of, after the second reaction step, further growing the seed particles while sufficiently stirring a slurry-like solution that comprises the magnetic iron oxide, to yield thereby the intended magnetic iron oxide particle.

By dividing thus the reaction step into three stages, the crystals of the magnetic iron oxide are grown more carefully than in conventional instances. Further, crystal growth of the magnetic iron oxide is caused to proceed uniformly, through stirring of the slurry-like solution that comprises the magnetic iron oxide, during the course of the reaction; a magnetic iron oxide particle can be obtained as a result that exhibits a smooth surface and in which the shapes of the magnetic iron oxide crystals are matched.

The various reaction steps for obtaining the magnetic iron oxide particle are explained in detail next, but the reaction steps are not limited thereto.

<First Reaction Step>

A ferrous salt aqueous solution and 0.90 to 1.00 equivalents of an alkali hydroxide aqueous solution, with respect to the ferrous salt in the ferrous salt aqueous solution, are caused to react. A water-soluble silicate is added, in an amount of 0.05 to 1.00 atom % in terms of Si with respect to Fe, to the ferrous salt solution comprising the resulting ferrous hydroxide colloid. Next, the pH of the ferrous salt reaction solution comprising the ferrous hydroxide colloid is adjusted to a range of 8.0 to 9.0. Next, an oxidation reaction is carried out through aeration using an oxygen-containing gas while under heating at a temperature ranging from 70 to 100° C., until the oxidation reaction rate of iron reaches 7 to 12%, to generate magnetite nucleus crystal particles.

<Second Reaction Step>

An alkali hydroxide aqueous solution is added up to 1.01 to 1.50 equivalents with respect to the ferrous salt reaction solution comprising the ferrous hydroxide colloid and the resulting magnetite nucleus crystal particles, and the oxidation reaction is performed through aeration using the oxygen-containing gas, while under heating at a temperature ranging from 70 to 100° C., until the oxidation reaction rate of iron reaches 40 to 60%.

<Third Reaction Step>

Herein, the pH is adjusted preferably to 5.0 to 9.0, while under stirring, to lower the viscosity of the reaction solution and facilitate stirring. The reaction solution is then stirred until it becomes uniform. The reason for adjusting the pH from alkaline pH to neutral pH is to facilitate stirring through lowering of the slurry viscosity. The term "relay condition" denotes the pH of the reaction solution for facilitating stirring through lowering of the viscosity of the reaction solution. Thereafter, the pH is re-adjusted to 9.5 or higher, the water-soluble silicate is added in an amount of 20 to 200% with respect to the water-soluble silicate that had been added in the first reaction step (in such a manner that the total of silicon added in the first reaction step and the third reaction step is 1.9 atom % or less), and the oxidation reaction is performed through aeration using the oxygen-containing gas while under heating at a temperature range of 70 to 100° C.

As needed, a step may be further added of covering the surface of the magnetic iron oxide particle that is obtained as a result of the above steps.

In the magnetic iron oxide particle of the present invention, the proportion of magnetic iron oxide particle having a particle diameter smaller than 0.05 μm is preferably not more than 10 number %, more preferably not more than 5 number %, with respect to the total of magnetic iron oxide particles. If the proportion of the number of particles of magnetic iron oxide having a particle diameter smaller than 0.05 μm lies within the above range, the specific surface area of the magnetic iron oxide particle is not excessively large, and scraping of toner carrying member surface by the magnetic toner does not occur readily. A magnetic iron oxide particle such that the proportion of magnetic iron oxide particle having a number-average particle diameter smaller than 0.05 μm is 10 number % or less, is obtained by, for instance, dividing the oxidation reaction and performing stirring during the oxidation reaction, to cause thereby the oxidation reaction to proceed uniformly during production of the magnetic iron oxide particle, as described above. Magnetic iron oxide particles having a number-average particle diameter smaller than 0.05 μm can be obtained through classification using a classifier.

Preferably, the shape of the magnetic iron oxide particle used in the present invention is an octahedral shape. If the shape of the magnetic iron oxide particle is an octahedral shape, the dispersibility of the magnetic iron oxide particle at the time of dispersion in the binder resin is better, and a magnetic toner of higher tinting strength can be obtained as a result.

The exothermic onset temperature of the magnetic iron oxide particle that is used in the present invention is preferably at least 160° C., more preferably at least 165° C. The exothermic onset temperature is the temperature at which an exothermic reaction starts during heating of the magnetic iron oxide particle, i.e. the temperature at which the oxidation reaction of the magnetic iron oxide particle starts. If the exothermic onset temperature is 160° C. or higher, the magnetic iron oxide particle surface is not oxidized readily, and a magnetic toner of high degree of blackness is readily obtained, in the heating step during the production of the magnetic toner. Methods for bringing the exothermic onset temperature of the magnetic iron oxide particle to 160° C. or higher include, for instance, a method that involves enhancing the heat resistance of the surface of the magnetic iron oxide particle through coating with a silicon compound, an aluminum compound or the like, or a method of hindering oxidation by rendering the product of the specific surface area of the magnetic iron oxide particle smaller. The exothermic onset temperature of the magnetic iron oxide particle is preferably not more than 220° C.

The content of the magnetic iron oxide particle in the magnetic toner of the present invention ranges preferably from 30 parts by mass to 100 parts by mass, more preferably from 30 parts by mass to 75 parts by mass, and yet more preferably from 30 parts by mass to 60 parts by mass, with respect to 100 parts by mass of binder resin comprised in the magnetic toner. If the content of magnetic iron oxide particle with respect to 100 parts by mass of the binder resin is 30 parts by mass or greater, it becomes possible to control the amount of magnetic toner that flies off from the toner carrying member towards a photosensitive member surface, on account of the magnetic binding force of the magnets inside the toner carrying member. Fogging and tailing can be suppressed more easily as a result. If the content of magnetic iron oxide particle with respect to 100 parts by mass of the binder resin is 100 parts by mass or less, the number of particles of magnetic iron oxide particle that are exposed at the magnetic toner surface is moderate, and charge leakage derived from the magnetic iron oxide particle does not occur readily. As a result, a magnetic toner can be obtained in which fogging and tailing are further suppressed.

Preferably, the magnetic iron oxide particle used in the present invention contains silicon in an amount ranging from 0.19 atom % to 1.90 atom % in terms of silicon with respect to iron. A magnetic iron oxide particle of superior degree of blackness can be obtained if the content of silicon lies within the above range. Preferably, the content of aluminum ranges preferably from 0.10 atom % to 1.00 atom % in terms of aluminum with respect to iron. If the content of aluminum lies in that range, charging performance control of the magnetic toner improves, and fogging can be made less likely to occur. Preferably, the magnetic iron oxide particle contains both silicon and aluminum.

Preferably, a silicon dissolution rate Y satisfies Expressions (2) and (3) that include a silicon dissolution rate (a) at an iron dissolution rate of 10% when the iron dissolution rate X upon dissolution of the above magnetic iron oxide particle in a hydrochloric acid solution ranges from more than 20% up to 80%.

$$\{(100-a)X+100(a-10)\}/90-10(1-a/100)\leq Y\leq\{(100-a)X+100(a-10)\}/90+10(1-a/100) \quad (2)$$

$$10\leq a\leq 80 \quad (3)$$

(where $20<X\leq 80$)

In the expressions, a denotes the silicon dissolution rate at an iron dissolution rate of 10%, X denotes the iron dissolution rate at a time where the magnetic iron oxide particle is dissolved in a hydrochloric acid solution, and Y denotes the silicon dissolution rate at a time where the iron dissolution rate is X upon dissolution of the magnetic iron oxide particle in the hydrochloric acid solution.

The above relational expressions describe a distribution of silicon inside magnetic iron oxide particle upon dissolution of the magnetic iron oxide particle in the hydrochloric acid solution. Expressions (2) and (3) below being satisfied signifies that the silicon is distributed within the magnetic iron oxide particle in a nearly uniform state, with the iron dissolution rate in a range from 20% to 80%. If the distribution of silicon within the magnetic iron oxide particle is uniform, the magnetic iron oxide particle adopts a uniform crystalline structure, and the shape of the magnetic iron oxide particle surface is accordingly smoother. If such a magnetic iron oxide particle is used in the magnetic toner, it becomes as a result possible to suppress scraping of the toner carrying member surface by the magnetic toner, and to inhibit fogging and tailing. The magnetic iron oxide particle that satisfies Expressions (2) and (3) is obtained, for instance, by dividing the oxidation reaction and by performing stirring with lowered viscosity of a slurry solution, during production of the magnetic iron oxide particle, as described above, to render uniform thereby the distribution of silicon in the magnetic iron oxide particle.

Resins that are ordinarily used in magnetic toners can be used as the binder resin of the present invention. Preferred among the foregoing are resins having polyester units, from the viewpoint of dispersibility of the magnetic iron oxide particle in the binder resin. In the present invention, the term "polyester unit" denotes portions derived from polyester. Examples of resins having polyester units include, for instance, polyester resins, and hybrid resins in which polyester units and other resin units are bonded together. Examples of the other resins include, for instance, vinyl resins, polyurethane resins, epoxy resins and phenolic resins.

The components that make up the polyester unit that is used in the present invention are explained in detail below. The components below can be used singly or in combinations of two or more types, in accordance with the component type and the intended applications. Examples of acid components include the following divalent carboxylic acids and derivatives thereof: benzene dicarboxylic acids such as phthalic acid, terephthalic acid and isophthalic acid, or anhydrides thereof or lower alkyl esters thereof; alkyl dicarboxylic acids such as succinic acid, adipic acid, sebacic acid and azelaic acid, or anhydrides thereof or lower alkyl esters thereof; C1-50 alkenyl succinates or alkyl succinates, or anhydrides thereof or lower alkyl esters thereof; unsaturated dicarboxylic acids such as fumaric acid, maleic acid, citraconic acid and itaconic acid, or anhydrides thereof or lower alkyl esters thereof.

Examples of alcohol components include for instance the divalent alcohols below: ethylene glycol, polyethylene glycol, 1,2-propanediol, 1,3-propanediol, 1,3-butanediol, 1,4-butanediol, 2,3-butanediol, diethylene glycol, triethylene glycol, 1,5-pentane diol, 1,6-hexanediol, neopentyl glycol, 2-methyl-1,3-propanediol, 2-ethyl-1,3-hexane diol, 1,4-cyclohexanedimethanol (CHDM), hydrogenated bisphenol A and bisphenols represented by chemical formula (1) and derivatives thereof; and diols represented by chemical formula (2) below.

[C1]

(1)

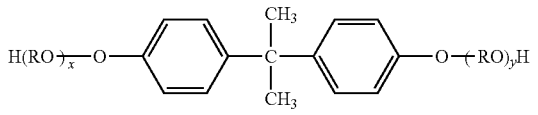

(In the formula, R is an ethylene or propylene group, x and y are each integers equal to or higher than 0, such that the average value of x+y is 0 to 10.)

[C2]

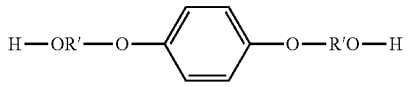

(In the formula, R' denotes (2)

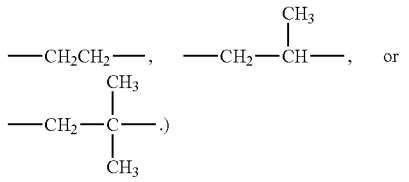

The components that make up the polyester unit that is used in the present invention may contain, as structural components, trivalent or higher carboxylic acid compounds or trivalent or higher alcohol compounds other than the above-described divalent carboxylic acid compounds and divalent alcohol compounds.

The trivalent or higher carboxylic acid compound is not particularly limited, and may be, for instance, trimellitic acid, trimellitic anhydride, pyromellitic acid and the like.

Examples of the trivalent or higher alcohol compound include, for instance, trimethylolpropane, pentaerythritol, glycerol and the like.

The method for producing the polyester unit that is used in the present invention is not particularly limited, and a known method may be resorted to. For instance, the polyester unit can be produced by simultaneously charging the above-described carboxylic acid compounds and alcohol compounds, and performing polymerization through an esterification reaction or transesterification reaction and a condensation reaction. The polymerization temperature is not particularly limited, but ranges preferably from 180° C. to 290° C. A polymerization catalyst can be used during polymerization, for instance a titanium-based catalyst, a tin-based catalyst, zinc acetate, antimony trioxide, germanium dioxide or the like. More preferably, in particular, the binder resin of the present invention is a polyester unit resulting from polymerization in use of a titanium-based catalyst.

Examples of titanium compounds as the titanium-based catalyst include, for instance, titanium diisopropylate bistriethanolaminate [$Ti(C_6H_{14}O_3N)_2(C_3H_7O)_2$], titanium diisopropylate bisdiethanol aminate [$Ti(C_4H_{10}O_2N)_2(C_3H_7O)_2$], titanium dipentylate bistriethanolaminate [$Ti(C_6H_{14}O_3N)_2(C_5H_{11}O)_2$], titanium diethylate bistriethanolaminate [$Ti(C_6H_{14}O_3N)_2(C_2H_5O)_2$], titanium dihydroxyoctylate bistriethanolaminate [$Ti(C_6H_{14}O_3N)_2(OHC_8H_{16}O)_2$], titanium distearate bistriethanolaminate [$Ti(C_6H_{14}O_3N)_2(C_{18}H_{37}O)_2$], titanium triisopropylate triethanolaminate [$Ti(C_6H_{14}O_3N)_1(C_3H_7O)_3$] and titanium monopropylate tris (triethanolaminate) [$Ti(C_6H_{14}O_3N)_3(C_3H_7O)_1$]. Preferred among the foregoing are titanium diisopropylate bistriethanolaminate, titanium diisopropylate bisdiethanolaminate and titanium dipentylate bistriethanolaminate.

Other examples of titanium compounds as the titanium-based catalyst include, for instance, tetra-n-butyl titanate [$Ti(C_4H_9O)_4$], tetrapropyl titanate [$Ti(C_3H_7O)_4$], tetrastearyl titanate [$Ti(C_{18}H_{37}O)_4$], tetramyristyl titanate [$Ti(C_{14}H_{29}O)_4$], tetraoctyl titanate [$Ti(C_8H_{17}O)_4$], dioctyldihydroxyoctyl titanate [$Ti(C_8H_{17}O)_2(OHC_8H_{16}O)_2$] and dimyristyl dioctyl titanate [$Ti(C_{14}H_{29}O)_2(C_8H_{17}O)_2$]. [$Ti(C_{14}H_{29}O)_2(C_8H_{17}O)_2$]. Preferred among the foregoing are tetrastearyl titanate, tetramyristyl titanate, tetraoctyl titanate and dioctyldihydroxyoctyl titanate. The foregoing can be obtained, for instance, by causing a titanium halide to react with a corresponding alcohol. More preferably, the titanium compound comprises an aromatic carboxylic acid titanium compound. Preferably, the aromatic carboxylic acid titanium compound obtained as a result of a reaction between an aromatic carboxylic acid and a titanium alkoxide. Preferably, the aromatic carboxylic acid is a divalent or higher aromatic carboxylic acid and/or aromatic oxycarboxylic acid having two or more carboxyl groups. Examples of the divalent or higher aromatic carboxylic acid include, for instance, dicarboxylic acids such as phthalic acid, isophthalic acid, and terephthalic acid, or anhydrides thereof; and polycarboxylic acid, such as trimellitic acid, benzophenone dicarboxylic acid, benzophenone tetracarboxylic acid, naphthalene dicarboxylic acid, naphthalene tetracarboxylic acid, or anhydrides and esterified products thereof. Examples of aromatic oxycarboxylic acids include, for instance, salicylic acid, m-hydroxybenzoic acid, p-hydroxybenzoic acid, gallic acid, mandelic acid, tropic acid and the like. More preferably, a divalent or higher carboxylic acid is used among the foregoing, in particular, preferably, isophthalic acid, terephthalic acid, trimellitic acid or naphthalene dicarboxylic acid.

The binder resin of the present invention may be a hybrid resin resulting from chemical bonding of a polyester unit and a vinyl copolymer unit. If a hybrid resin is used in the present invention, then at least styrene is preferably used as the vinylic monomer that makes up the vinyl copolymer unit in the hybrid resin. Examples of vinylic monomers, other than styrene, that make up the vinyl copolymer unit include, for instance, the styrenic monomer and acrylic acid-based monomers below.

Examples of styrenic monomers include, for instance, styrene derivatives such as o-methylstyrene, m-methylstyrene, p-methylstyrene, p-phenyl styrene, p-ethyl styrene, 2,4-dimethyl styrene, p-n-butyl styrene, p-tert-butyl styrene, p-n-hexyl styrene, p-n-octyl styrene, p-n-nonyl styrene, p-n-decyl styrene, p-n-dodecyl styrene, p-methoxy styrene, p-chlorostyrene, 3,4-di-chlorostyrene, m-nitrostyrene, o-nitrostyrene and p-nitrostyrene.

Examples of acrylic acid-based monomers include, for instance, acrylic acid and acrylic acid esters such as acrylic acid, methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate and phenyl acrylate; α-methylene aliphatic monocarboxylic acids and esters thereof, for instance, methacrylic acid, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate and the like; and acrylic acid and methacrylic acid derivatives such as acrylonitrile, methacrylonitrile and acrylamide.

Examples of other monomers that make up the vinyl copolymer units include, for instance, monomers having a hydroxyl group, for instance acrylic acid or methacrylic acid esters such as 2-hydroxyethyl acrylate, 2-hydroxyethyl methacrylate and 2-hydroxyl propyl methacrylate as well as 4-(1-hydroxy-1-methylbutyl) styrene and 4-(1-hydroxy-1-methylhexyl) styrene.

Various vinyl-polymerizable monomers may be used concomitantly, as needed, in the vinyl copolymer units. Examples of such monomers include, for example ethylenically unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; vinyl ethers such as vinylmethyl ether, vinylethyl ether and vinylisobutyl ether; vinyl ketones such as vinyl methyl ketone, vinyl hexyl ketone and methyl isopropenyl ketone; N-vinyl compounds such as N-vinyl pyrrole, N-vinyl carbazole, N-vinyl indole and N-vinyl pyrrolidone; vinylnaphthalenes; and also unsaturated dibasic acids such as maleic acid, citraconic acid, itaconic acid, alkenyl succinic acid, fumaric acid and mesaconic acid; unsaturated dibasic acid anhydrides such as maleic anhydride, citraconic anhydride, itaconic anhydride and alkenyl succinic anhydride; half esters of unsaturated dibasic acids, for instance, methyl maleic acid half ester, ethyl maleic acid half ester, butyl maleic acid half ester, methyl citraconic acid half ester, ethyl citraconic acid half ester, butyl citraconic acid half ester, methyl itaconic acid half ester, methyl alkenyl succinic acid half ester, methyl fumaric acid half ester, and methyl mesaconic acid half ester; unsaturated dibasic acid esters such as dimethyl maleate and dimethyl fumarate; anhydrides of α,β-unsaturated acids such as acrylic acid, methacrylic acid, crotonic acid and cinnamic acid; anhydrides of the above α,β-unsaturated acids and lower fatty acids; and monomers having a carboxyl group such as alkenyl malonic acid, alkenyl glutaric acid, alkenyl adipic acid, as well as anhydrides thereof and monoesters thereof.

As the case may require, the vinyl copolymer unit may be a polymer resulting from cross-linking by crosslinkable monomers such as the following monomers exemplified. Examples of crosslinkable monomers include, for instance, aromatic divinyl compounds, diacrylate compounds linked by an alkyl chain, diacrylate compound linked by an alkyl chain comprising an ether bond, diacrylate compounds linked by a chain that comprises an aromatic group and an ether bond; polyester-type diacrylates; and multifunctional crosslinking agents.

Examples of the aromatic divinyl compound include, for instance, divinyl benzene and divinyl naphthalene.

Examples of the diacrylate compound linked by an alkyl chain include, for instance, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and compounds resulting from substituting methacrylate for the acrylate in the foregoing compounds.

Examples of diacrylate compounds linked by an alkyl chain that comprises an ether bond include, for instance, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds resulting from substituting methacrylate for the acrylate in the foregoing compounds.

Examples of diacrylate compounds linked by a chain that comprises an aromatic group and an ether bond include, for instance, polyoxyethylene (2)-2,2-bis(4-hydroxyphenyl) propane diacrylate, polyoxyethylene (4)-2,2-bis(4-hydroxyphenyl) propane diacrylate, and compounds resulting from substituting methacrylate for the acrylate in the foregoing compounds. Examples of polyester-type diacrylates include, for instance, MANDA (product name, by Nippon Kayaku Co., Ltd.).

Examples of the multi-functional crosslinking agent include, for instance, pentaerythritol triacrylate, trimethylol ethane triacrylate, trimethylolpropane triacrylate, tetramethylolmethane tetraacrylate, oligoester acrylate, and compounds resulting from substituting methacrylate for the acrylate in the foregoing compounds; and also, for instance, triallyl cyanurate, triallyl trimellitate and the like.

The hybrid resin that is used as the binder resin is a resin in which polyester units and vinyl copolymer units are chemically bonded to each other. Therefore, bonding between the polyester units and vinyl copolymer units that make up the hybrid resin may be accomplished through polymerization using a compound (hereafter referred to as "bireactive compound") that can react with monomers of both units. Examples of such a bireactive compound include, for instance, compounds such as fumaric acid, acrylic acid, methacrylic acid, citraconic acid, maleic acid, dimethyl fumarate and the like. Preferably used among the foregoing are fumaric acid, acrylic acid and methacrylic acid.

The method for obtaining the hybrid resin may involve, for instance, causing the starting monomers of the polyester units and the starting monomers of the vinyl copolymer units to react, simultaneously or sequentially.

The vinyl copolymer unit may be produced using a polymerization initiator. From the viewpoint of efficiency, the polymerization initiator is preferably used in an amount ranging from 0.05 parts by mass to 10 parts by mass with respect to 100 parts by mass of monomers.

Examples of the polymerization initiator include, for instance, ketone peroxides such as 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methyl butyronitrile), dimethyl-2,2'-azobisisobutyrate, 1,1'-azobis (1-cyclohexane carbonitrile), 2-carbamoyl azoisobutyronitrile, 2,2'-azobis(2,4,4-trimethyl pentane), 2-phenylazo-2,4-dimethyl-4-methoxyvaleronitrile, 2,2'-azobis(2-methylpropane), methyl ethyl ketone peroxide, acetylacetone peroxide and cyclohexanone peroxide; as well as 2,2-bis(t-butylperoxy) butane, t-butyl hydroperoxide, cumene hydroperoxide, 1,1,3,3-tetramethyl butyl hydroperoxide, di-t-butyl peroxide, t-butyl cumyl peroxide, dicumyl peroxide, α,α'-bis(t-butylperoxy isopropyl) benzene, isobutyl peroxide, octanoyl peroxide, decanoyl peroxide, lauroyl peroxide, 3,5,5-trimethyl hexanoyl peroxide, benzoyl peroxide, m-toluoyl peroxide, diisopropylperoxydicarbonate, di-2-ethylhexyl peroxydicarbonate, di-n-propyl peroxydicarbonate, di-2-ethoxyethyl peroxycarbonate, dimethoxy isopropyl peroxy dicarbonate, di(3-methyl-3-methoxy butyl) peroxycarbonate, acetylcyclohexylsulfonyl peroxide, t-butyl peroxy acetate, t-butyl peroxy isobutyrate, t-butyl peroxyneodecanoate, t-butyl peroxy-2-ethylhexanoate, t-butylperoxy laurate, t-butyl peroxy benzoate, t-butyl peroxy isopropyl carbonate, di-t-butylperoxy isophthalate, t-butylperoxy allyl carbonate, t-amyl peroxy-2-ethylhexanoate, di-t-butylperoxyhexahydroterephthalate and di-t-butylperoxyazelate.

Preferably, the mixing ratio of the polyester units and the vinylic copolymer units is a mass ratio of 50:50 to 90:10, from the viewpoint of controlling the crosslinked structure at the molecular level.

A release agent (wax) may be used in the present invention in order to impart releasing properties to the magnetic toner. Preferably, the wax is a Fischer-Tropsch wax, since the latter disperses readily in the magnetic toner particle and affords high releasing properties. The wax that is used may be a hydrocarbon wax. Examples of hydrocarbon waxes that can be used include, for instance, low-molecular weight polyethylene, low-molecular weight polypropylene, microcrystalline wax and paraffin wax. A small amount of one or two or more types of wax can be used concomitantly, as the case may require. Examples of waxes include, for instance, the following.

Oxides of aliphatic hydrocarbon waxes such as oxidized polyethylene wax, or block copolymers thereof; waxes having a fatty acid ester as a main component, for instance, carnauba wax, sasol wax and montanate wax; deoxidized waxes resulting from deoxidizing partly or entirely a fatty acid ester, for instance deoxidized carnauba wax; saturated straight chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, seryl alcohol and melissyl alcohol; long-chain alkyl alcohols; polyhydric alcohols such as sorbitol; fatty acid amides such as linoleic acid amide, oleic acid amide and lauric acid amide; saturated fatty acid bisamides such as methylene-bis-stearic acid amide, ethylene-bis-capric acid amide, ethylene-bis-lauric acid amide and hexamethylene bis-stearic acid amide; unsaturated fatty acid amides such as ethylene-bis-oleamide, hexamethylene bis-oleic acid amide, N,N'-dioleyl adipic acid amide and N,N-dioleylsebacic acid amide; aromatic bisamides such as m-xylene bis-stearic acid amide and N,N-dis-tearylisophthalic acid amide; fatty acid metal salts (ordinarily referred to as "metal soaps") such as calcium stearate, calcium laurate, zinc stearate and magnesium stearate; waxes resulting from grafting of an aliphatic hydrocarbon wax with a vinylic monomer such as styrene or acrylic acid; partial esters of fatty acids and polyhydric alcohols such as behenic acid monoglyceride; and methyl ester compounds having a hydroxyl group and obtained by hydrogenation of vegetable oils.

Specific examples of the above waxes include, for instance, the following. VISKOL (registered trademark) 330-P, 550-P, 660-P and TS-200 (all by Sanyo Chemical Industries, Ltd.); HIWAX 400P, 200P, 100P, 410P, 420P, 320P, 220P, 210P and 110P (all by Mitsui Chemicals, Inc.); SASOL H1, H2, C80, C105 and C77 (all by Sasol Wax); HNP-1, HNP-3, HNP-9, HNP-10, HNP-11, HNP-12 (all by NIPPON SEIRO CO., LTD.); UNILIN (registered trademark) 350, 425, 550 and 700, UNICID (registered trademark) 350, 425, 550 and 700 (all by Toyo Petrolite Co., Ltd.); and vegetable wax, bees wax, rice wax, candelilla wax, carnauba wax (all by CERARICA NODA Co., Ltd.).

The timing of the addition of the wax can be appropriately selected from among existing methods; the wax may thus be added at the time of melting and kneading during the production of the magnetic toner, or during production of the binder resin.

Preferably, the wax is added in an amount ranging from 1 part by mass to 20 parts by mass with respect to 100 parts by mass of the binder resin. If the addition amount of the wax lies in that range, the afforded release effect is sufficient and dispersion in the magnetic toner is likewise good, while adhesion of the magnetic toner on the electrostatic image bearing member, and surface contamination of a cleaning member tend to be less likely to occur.

A charge control agent can be used in the magnetic toner of the present invention with a view to stabilizing the charging characteristics of the magnetic toner. The content of charge control agent varies depending on the type of the charge control agent and on the physical properties of the materials that make up the magnetic toner particle, but, ordinarily, ranges preferably from 0.1 parts by mass to 10 parts by mass, more preferably from 0.1 parts by mass to 5 parts by mass, with respect to 100 parts by mass of the binder resin in the magnetic toner particle. As the charge control agent there can be used one, two or more types of charge control agent, in accordance with the type and intended use of the magnetic toner.

Examples of charge control agent for controlling the toner to exhibit positive charging performance, include the following: nigrosin and modified products of nigrosin with metal salts of fatty acids; quaternary ammonium salts such as tributylbenzyl ammonium-1-hydroxy-4-naphtosulfonate and tetrabutyl ammonium tetrafluoroborate, and analogs of the salts; onium salts such as phosphonium salts and lake pigments of the salts; triphenyl methane dyes and lake pigments of the dyes (laking agents include phosphotungstic acid, phosphomolybdic acid, phosphotungsten molybdic acid, tannic acid, lauric acid, gallic acid, ferricyanic acid, and ferrocyanide compounds); and metal salts of higher fatty acids. The foregoing can be used in the present invention as one type alone or in combinations of two or more types. Particularly preferred among the foregoing is a charge control agent such as a nigrosin compound or a quaternary ammonium salt.

Examples of charge control agents for controlling the toner to exhibit negative charging performance include the following. Organometallic complexes (monoazo metal complexes and acetylacetone metal complexes); metal complexes or metal salts of aromatic hydroxycarboxylic acids or aromatic dicarboxylic acids; aromatic mono and polycarboxylic acids, and metal salts and anhydrides thereof; as well as esters and phenol derivatives such as bisphenol. Particularly preferred among the foregoing is a monoazo metal complex or metal salt that affords stable charging characteristics.

A charge control resin as well can be used, concomitantly with the above-described charge control agent.

Preferably, an inorganic fine powder is externally added to the magnetic toner particle of the present invention, with a view to enhancing triboelectric charging stability, developability, flowability and durability. The BET specific surface area by nitrogen adsorption of the inorganic fine powder is preferably 30 $m^2/g$ or greater, and more preferably ranges from 50 $m^2/g$ to 400 $m^2/g$. Preferably, the inorganic fine powder is used in an amount ranging from 0.01 parts by mass to 8.00 parts by mass, more preferably from 0.10 parts by mass to 5.00 parts by mass, with respect to 100 parts by mass of the magnetic toner particle. The BET specific surface area of the inorganic fine powder can be calculated in accordance with a BET multipoint method, by causing nitrogen gas to adsorb onto the surface of the inorganic fine powder, using a specific surface area measurement device, for instance AUTOSORB 1 (by Yuasa Ionics Co., Ltd.), GEMINI 2360/2375 (by Micromeritics Instrument Corporation) or TriStar 3000 (by Micromeritics Instrument Corporation). Examples of the inorganic fine powder used in the present invention include, for instance: silica fine powder such as wet-process silica and dry-process silica, treated silica resulting from treating the foregoing silica types with a silane coupling agent, a titanium coupling agent, silicone oil or the like; titanium oxide fine powder; alumina fine powder, treated titanium oxide fine powder and treated alumina fine powder.

The inorganic fine powder may be used in an amount that ranges from 0.01 parts by mass to 8 parts by mass, preferably from 0.1 parts by mass to 4 parts by mass, with respect to 100 parts by mass of the magnetic toner particle.

The inorganic fine powder may be further treated, as needed, with a treatment agent or with various treatment agents such as an unmodified silicone varnish, silicone varnishes having undergone various modifications, unmodified silicone oil, silicone oil having undergone various modifications, a silane coupling agent, a silane compound having a functional group, and other organosilicon compounds, for the purpose of hydrophobization and triboelectric chargeability control.

An external additive other than the above inorganic fine powder may be further added to the magnetic toner of the present invention, as the case may require. Examples of external additives include, for instance, resin fine particles and inorganic fine particles that serve as charging adjuvants, conductivity-imparting agents, flowability-imparting agents, caking inhibitors, release agents for heat rollers, lubricants, and abrasives. Examples of lubricants include, for instance, polyethylene fluoride powder, zinc stearate powder, and fluororesin powder such as polyvinylidene fluoride powder and polytetrafluoroethylene fine powder. Examples of the abrasive include, for instance, cerium oxide powder, silicon carbide powder, and strontium titanate powder. The foregoing external addition agents are thoroughly mixed with the magnetic toner of the present invention using a mixer such as a Henschel mixer or the like.

The magnetic toner particle comprised in the magnetic toner of the present invention can be obtained, for instance, as a result of steps (1) to (5) below.

(1) The binder resin, the magnetic iron oxide particle, and, as needed, other additives, are mixed thoroughly in a mixer such as a Henschel mixer or a ball mill.

(2) The obtained mixture is melt-kneaded in a heating kneading device such as a heating roll, a kneader or an extruder.

(3) The obtained kneaded product is cooled and solidified.

(4) The solidified kneaded product is pulverized.

(5) The pulverized kneaded product is classified.

Further, the magnetic toner particle obtained through classification is thoroughly mixed with the above inorganic fine powder and so forth in a mixer such as a Henschel mixer or the like, to yield the magnetic toner as a result.

Examples of mixers include, for instance, the following:

Henschel mixer (by Mitsui Mining Co., Ltd.); Super mixer (by KAWATA MFG Co., Ltd.); Ribocorn (by OKAWARA MFG. CO., LTD.); Nautor Mixer, Turbulizer and Cycromix (all by Hosokawa Micron Corporation); Spiral pin mixer (by Pacific Machinery & Engineering Co., Ltd); and Loedige Mixer (by MATSUBO Corporation).

Examples of the kneader include the following:

KRC kneader (by Kurimoto, Ltd.); BUSS co-kneader (by BUSS); TEM type extruder (by TOSHIBA MACHINE CO., LTD.); TEX biaxial kneader (by The Japan Steel Works, LTD.); PCM kneader (by Ikegai Corp); triple roll mill, mixing roll mill and kneader (all by INOUE MFG., INC.); Kneadex (by Mitsui Mining Co., Ltd.); MS-system pressure kneader and Kneader-Ruder (all by MORIYAMA); and Banbury mixer (by Kobe Steel, Ltd.).

Examples of pulverizers include, for instance, the following.

Counter jet mill, Micron jet and Inomizer (all by Hosokawa Micron Corporation); IDS type mill and PJM jet pulverizer (all by Nippon Pneumatic Mfg. Co., Ltd.); Cross jet mill (by Kurimoto, Ltd.); ULMAX (by NISSO ENGINEERING CO., LTD); SK Jet O mill (by Seishin Enterprise Co., Ltd.); Cryptron (by Kawasaki Heavy Industries, Ltd.); Turbo mill (by Turbo Kogyo Co., Ltd.); and Super rotor (by Nisshin Engineering Inc.).

Examples of classifiers include, for instance, the following:

Classiel, Micron Classifier and Spedic Classifier (all by Seishin Enterprise Co., Ltd.); Turbo classifier (by Nisshin Engineering Inc.); Micron separator, Turbo plex (ATP) and TSP separator (all by Hosokawa Micron Corporation); Elbow jet (by Nittetsu Mining Co., Ltd.), Dispersion separator (by Nippon Pneumatic Mfg. Co., Ltd.); and YM microcut (by Yasukawa Shoji Co., Ltd.).

Examples of sieving apparatuses for sieving and separating coarse particles include, for instance, the following:

Ultrasonic (by KOEI SANGYO CO., LTD.); Resona Sieve and Gyro Shifter (all by TOKUJU CORPORATION); Vibra Sonic System (by DALTON CO., LTD.); Soni Clean (by SINTOKOGIO, LTD.); Turbo Screener (by Turbo Kogyo Co., Ltd.); Micro Shifter (by Makino mfg Co., Ltd.); and a circular vibration sieve.

Methods for measuring the various properties of the magnetic iron oxide particle comprised in the magnetic toner according to the present invention will be described next.

(1) Measurement of the shape of the magnetic iron oxide particle and of the number-average particle diameter, and calculation of the proportion of the number of magnetic iron oxide particle having a particle diameter smaller than 0.05 μm The particle shape, number-average particle diameter and particle size distribution of the magnetic iron oxide particle are observed and measured using a "Scanning electron microscope S-4800" (by Hitachi High-Technologies Corporation). The number-average particle diameter of the magnetic iron oxide particle is calculated as the arithmetic average of the average particle diameter of 300 magnetic iron oxide particles, from electron micrographs, taking herein the particle diameter of the particles as the average of the lengths of two longitudinal and transversal sides of magnetic iron oxide particles. The proportion of the number of particles of magnetic iron oxide having a particle diameter smaller than 0.05 μm is calculated by working out the number of particles of magnetic iron oxide having a particle diameter smaller than 0.05 μm from among the calculated 300 magnetic iron oxide particles, and by dividing that number of particles by the total of 300 particles.

The magnetic iron oxide particle comprised in the magnetic toner can be obtained by dissolving the magnetic toner in a tetrahydrofuran solution, followed by retrieval of the magnetic iron oxide particle alone, from the solution, using a magnet.

(2) Measurement of the Exothermic Onset Temperature of the Magnetic Iron Oxide Particle The exothermic onset temperature of a magnetic iron oxide particle is measured using a "differential scanning calorimeter DSC6200" (by Seiko Instruments Inc.). The measurement conditions involved: sample amount: 20 to 21 mg, temperature rise rate: 10° C./min, air flow rate: 50 m L/min. The exothermic onset temperature is taken as the temperature at the intersection of a base line and the tangent at an exothermic onset inflection point of the obtained differential scanning calorimetry curve.

(3) Measurement of the BET Specific Surface Area of the Magnetic Iron Oxide Particle The measurement of the BET specific surface area of the magnetic iron oxide particle is performed in accordance with JIS 28830 (2001). The specific measurement method is as follows.

The measurement device used herein is an "automatic specific surface area • pore distribution analyzer TriStar 3000 (by SHIMADZU CORPORATION)" that relies on a constant-volume gas adsorption method as the measurement scheme. The measurement conditions are set and the measured data are analyzed using the dedicated software "TriStar 3000 Version 4.00" that comes with the device. A vacuum pump, nitrogen gas piping and helium gas piping are connected to the device. The value calculated in accordance with a BET multipoint method, using nitrogen gas as the adsorption gas, yields the BET specific surface area in the present invention.

The BET specific surface area is concretely calculated as follows.

Firstly, nitrogen gas is caused to adsorb onto the magnetic iron oxide particle, and the equilibrium pressure P (Pa) inside a sample cell as well as the nitrogen adsorption amount Va ($mol \cdot g^{-1}$) of the magnetic iron oxide particle at that time are both measured. An adsorption isotherm is then obtained, with a relative pressure Pr, being a value resulting from dividing the equilibrium pressure P (Pa) inside the sample cell by the saturated vapor pressure Po (Pa) of nitrogen, in the abscissa axis, and the nitrogen adsorption amount Va ($mol \cdot g^{-1}$) in the ordinate axis. Next, a monomolecular layer adsorption amount Vm ($mol \cdot g^{-1}$), which is the adsorption amount necessary for forming a monomolecular layer on the surface of the magnetic iron oxide particle, is worked out using the BET expression below:

$$Pr/Va(1-Pr)=1/(Vm\times C)+(C-1)\times Pr/(Vm\times C).$$

(Herein, C is the BET parameter, which is a variable that varies depending on the type of the measurement sample, the type of adsorption gas and the adsorption temperature.)

The BET expression can be interpred as the straight line (referred to as BET plot) having an intercept 1/(Vm×C) and a slope (C−1)/(Vm×C), with Pr in the X-axis and Pr/Va(1−Pr) in the Y-axis.

$$\text{Slope of straight line}=(C-1)/(Vm\times C)$$

$$\text{Intercept of straight line}=1/(Vm\times C)$$

The measured value of Pr and the measured value of Pr/Va(1−Pr) are plotted on the graph, a straight line is drawn, by least squares, and the slope and the intercept of the straight line are calculated. These values are used to solve the system of equations of the slope and intercept and calculate thereby Vm and C.

Further, the BET specific surface area S ($m^2 \cdot g^{-1}$) of the magnetic iron oxide particle is calculated on the basis of the expression below, using the calculated Vm and the molecular cross-sectional area (0.162 $nm^2$) of nitrogen molecules:

$$S=Vm\times N\times 0.162\times 10^{-18}$$

(where N is Avogadro's number ($mol^{-1}$)).

The method for calculating Vm is explained in detail next. The method for measuring Vm using the present device involves specifically performing a measurement in accordance with the procedure below, as per the "TriStar 3000 Instruction Manual V4.0" that comes with the device.

The tare weight of a dedicated sample cell made of glass (having a stem diameter of ⅜ inch and a volume of about 5 ml) having been thoroughly washed and dried is weighed exactly. Then, about 2 g of the magnetic iron oxide particle is loaded into the sample cell using a funnel. The sample cell containing the magnetic iron oxide particle is set in a "pretreatment apparatus VacuPrep 061 (by SHIMADZU CORPORATION)" to which a vacuum pump and nitrogen gas piping are connected, whereupon vacuum degassing is continued at 23° C. for about 10 hours. Vacuum degassing is gradually performed while a valve is adjusted in such a manner that the magnetic iron oxide particle is not sucked by the vacuum pump. Pressure in the cell gradually drops accompanying degassing, to reach eventually about 0.4 Pa (about 3 mTorr). Once vacuum degassing is over, nitrogen gas is gradually injected to return the pressure in the sample cell to atmospheric pressure, and then the sample cell is removed from the pretreatment apparatus. The mass of the sample cell is weighed exactly, and the accurate mass of the magnetic iron oxide particle is calculated on the basis of the difference between the tare weight and the mass. The sample cell is capped with a rubber stopper during the weighing in such a way so as to prevent the magnetic iron oxide particle in the sample cell from being contaminated with, for example, moisture in air.

Next, a dedicated "isothermal jacket" is attached to a stem portion of the sample cell containing the magnetic iron oxide particle. A dedicated filler rod is inserted into the sample cell, and the latter is set in an analysis port of the apparatus. The isothermal jacket is a tubular member having an inner surface of a porous material and an outer surface of an impervious material, such that the isothermal jacket is capable of suctioning up liquid nitrogen, to a given level, by capillarity.

The free space of the sample cell including a connection fixture is measured next. The volume of the sample cell is measured using helium gas at 23° C.; next, the volume of the sample cell is measured, using likewise helium gas, after the sample cell has been cooled in liquid nitrogen, and the free space is calculated through conversion on the basis of the difference between the foregoing volumes. The saturated vapor pressure Po (Pa) of nitrogen is measured automatically, separately, using a Po tube that is built into the apparatus.

Next, the interior of the sample cell is vacuum-degassed, and the sample cell is cooled in liquid nitrogen while vacuum degassing is continued. Thereafter, nitrogen gas is introduced in the sample cell in a stepwise manner so that the nitrogen molecules are caused to adsorb onto the magnetic iron oxide particle. Herein, an adsorption isotherm can be obtained by measuring the equilibrium pressure P (Pa) at arbitrary times. The adsorption isotherm is therefore converted to a BET plot. Six points of relative pressure Pr at which data are collected are set herein, namely 0.05, 0.10, 0.15, 0.20, 0.25 and 0.30. A straight line is drawn for the obtained measurement data by least-squares, and Vm is calculated from the slope and intercept of the straight line. The BET specific surface area of the magnetic iron oxide particle is calculated, as described above, using the value for Vm.

(4) Oxidation Reaction Rate

The oxidation reaction rate of the ferrous salt in the first reaction step and the second reaction step is calculated in accordance with the expression below, upon measurement of the $Fe^{2+}$ content in the reaction solution:

$$\text{Oxidation reaction rate (\%)}=(A-B)/A\times 100.$$

Herein, A denotes the $Fe^{2+}$ content in the reaction solution immediately after mixing of the ferrous salt aqueous solution and the alkali hydroxide aqueous solution, and B denotes the $Fe^{2+}$ content in the ferrous salt reaction solution that comprises that mixture of ferrous hydroxide and magnetite particles.

(5) Si and Al Content

The Si amount and the Al amount in the magnetic iron oxide particle are measured using a "Fluorescent X-ray Analyzer RIX-2100" by Rigaku Corporation, and are calculated as values worked out in terms of the foregoing elements with respect to Fe comprised in the magnetic iron oxide particle.

(6) Surface Si Amount and Surface Al Amount

The surface Si amount and surface Al amount of the magnetic iron oxide particle can be determined as follows.

(i) The total Si amount and total Al amount in the magnetic iron oxide particle are measured.

(ii) The magnetic iron oxide particle and deionized water are mixed, followed by dispersion to prepare a suspension.

(iii) The obtained suspension and an alkali hydroxide aqueous solution are mixed and are stirred for 30 minutes or longer. Thereafter, the suspension is filtered and dried, and the Si amount and Al amount of the obtained magnetic iron oxide particle are measured.

(iv) There is calculated the difference between the total Si amount and the total Al amount before treatment with the above alkali and the total Si amount and the total Al amount after treatment with the above alkali. The proportion of the calculated difference of Si amount and Al amount with respect to Fe comprised in the magnetic iron oxide particle is then calculated.

(7) Dissolution Rate of Silicon

The dissolution rate of silicon with respect to the dissolution rate of iron can be worked out in accordance with the following method. Herein, 30 g of magnetic iron oxide particle are suspended in 3 L of a 3 mol/L hydrochloric acid solution. Next, the temperature of the magnetic iron oxide particle suspension-hydrochloric acid solution is kept at 50° C., while samples are taken at predetermined intervals of time, until all the magnetic iron oxide particle dissolves. Filtrates are obtained herein through filtering using a membrane filter. The iron and the silicon in each filtrate are quantified using an inductively coupled plasma atomic emission spectrophotometer. The iron dissolution rate and the silicon dissolution rate are calculated on the basis of the expressions below.

Iron dissolution rate $X$ (%)=iron concentration (mg/L) in each sample/iron concentration (mg/L) upon complete dissolution of magnetic iron oxide particle×100

Silicon dissolution rate $Y$ (%)=silicon concentration (mg/L) in each sample/silicon concentration (mg/L) upon complete dissolution of magnetic iron oxide particle×100

The silicon dissolution rate at an iron dissolution rate of 10% is calculated using the expression for working out the silicon dissolution rate (%) on the basis of the silicon concentration in the sample for which the iron dissolution rate is 10%, in the expression for working out the iron dissolution rate (%) above.

In the present invention there is measured the silicon dissolution rate Y at each respective range of the iron dissolution rate X, namely X greater than 20% up to 40% (i.e. $X_{20\ to\ 40}$), X greater than 40% up to 60% (i.e. $X_{40\ to\ 60}$) and X greater than 60% up to 80% (i.e. $X_{6C\ to\ 80}$), such that $Y_{20\ to\ 40}$, $Y_{40\ to\ 60}$ and $Y_{60\ to\ 8C}$ correspond respectively to $X_{20\ to\ 40}$, $X_{40\ to\ 60}$ and $X_{60\ to\ 8C}$, of the iron dissolution rate X. It was checked that X and Y fell within the ranges of expressions (2) and (3) below, which include the silicon dissolution rate (a) at an iron dissolution rate of 10%.

$$\{(100-a)X+100(a-10)\}/90-10(1-a/100)\leq Y\leq\{(100-a)X+100(a-10)\}/90+10(1-a/100) \quad (2)$$

$$10\leq a\leq 80 \quad (3)$$

(where $20<X\leq 80$)

EXAMPLES

The basic configuration and features of the present invention have been described above. The present invention will be explained in specific terms below on the basis of examples. However, the present invention is not limited to any of the examples.

The magnetic iron oxide particle of the present invention was produced as follows.

Production Example of Magnetic Iron Oxide 1

(First reaction step) A ferrous salt suspension was prepared by mixing 16 L of a ferrous sulfate aqueous solution comprising 1.5 mol/L of $Fe^{2+}$ ($Fe^{2+}$: 24 moles) and 15.2 L of a 3.0 N sodium hydroxide solution (corresponding to 0.95 equivalents with respect to $Fe^{2+}$, i.e. 2OH/Fe=0.95), with adjustment of the pH to 8.5. A solution resulting from diluting 13.3 g of #3 liquid glass ($SiO_2$ 28.8 mass %), as a silicon component (corresponding to 0.25 atom % in terms of Si with respect to Fe, i.e. Si/Fe (atom %)=0.25), in 0.5 L of deionized water was added to sodium hydroxide. The ferrous salt suspension was aerated with 70 L of air per minute, at a temperature of 90° C., to perform an oxidation reaction until the oxidation reaction rate of the ferrous salt reached 10%. A ferrous salt suspension comprising magnetite nucleus crystal particles was thus obtained.

(Second Reaction Step)

Next, 3.2 L of a 3.0 N sodium hydroxide solution were added to the above ferrous salt suspension comprising the magnetite nucleus crystal particles (corresponding to 1.15 equivalents with respect to $Fe^{2+}$, i.e. 2OH/Fe=1.15), and the whole was aerated with 70 L of air per minute, at a temperature of 90° C., to perform an oxidation reaction until the oxidation reaction rate of the ferrous salt reached 50%.

(Third Reaction Step)

Next, an appropriate amount of 16.0 N sulfuric acid was added to the ferrous salt suspension comprising the magnetite nucleus crystal particles, to adjust the pH to 7.5, and the suspension was stirred. The pH condition at this time is referred to as the relay condition. Next, the pH was adjusted to 10.5 through addition of an appropriate amount of a 3.0 N sodium hydroxide solution. A solution resulting from diluting 21.3 g of #3 liquid glass ($SiO_2$ 28.8 mass %), as a silicon component (corresponding to 0.40 atom % in terms of Si with respect to Fe, i.e. Si/Fe (atom %)=0.40) in 0.5 L of deionized water, was added to the above ferrous salt suspension comprising magnetic iron oxide nucleus crystal particles, and the whole was aerated with 70 L of air per minute, at a temperature of 90° C., to yield a magnetic iron oxide.

Further, a Si and Al coat layer was formed, to yield magnetic iron oxide 1, by adding appropriate amounts, as given in Table 1, of #3 liquid glass as the silicon component and a 1.9 mol/L aluminum sulfate solution as the aluminum component, to the suspension comprising magnetite nucleus crystal particles, and by adjusting the pH to 7.0.

The obtained magnetic iron oxide 1 was washed with water, filtered off, dried and pulverized in accordance with ordinary methods. The obtained magnetic iron oxide 1 was octahedral, had a number-average particle diameter of 0.12 μm, a Si content of 0.57 atom % and an Al content of 0.86 atom %.

The silicon dissolution rate (a) at an iron dissolution rate of 10% of the magnetic iron oxide 1 was 64.8%, the silicon dissolution rate ($Y_{20\ to\ 4C}$) at an iron dissolution rate greater than 20% up to 40% ($X_{20\ to\ 4C}$) was 70.1%, the silicon dissolution rate ($Y_{40\ to\ 6C}$) at an iron dissolution rate greater than 40% up to 60% ($X_{40\ to\ 60}$) was 80.2%, and the silicon dissolution rate ($Y_{60\ to\ 8C}$) at an iron dissolution rate greater than 60% up to 80% ($X_{60\ to\ 80}$) was 86.1%. The composition and preparation conditions of magnetic iron oxide 1 are given in Table 1, and the various properties of magnetic iron oxide 1 are given in Table 2.

Production Example of Magnetic Iron Oxides 2 to 11 and Magnetic Iron Oxides 14 to 16>

Magnetic iron oxides 2 to 11 and magnetic iron oxides 14 to 16 were obtained in the same way as in the case of magnetic iron oxide 1, but herein the equivalent ratio (2OH/Fe) of ferrous sulfate and sodium hydroxide, the added silicon content (Si/Fe (atom %)) and the pH up to an oxidation reaction rate of 10%, in the first reaction step, the equivalent ratio (2OH/Fe) of ferrous sulfate and sodium hydroxide, the added silicon content (Si/Fe (atom %)) and the relay-condition pH, in the second reaction step, as well as the pH and the added silicon content (Si/Fe (atom %)), in the third reaction step, were modified as given in Table 1. Further, a Si and Al coat layer was formed by adding appropriate amounts, as given in Table 1, of #3 liquid glass as the silicon component and a 1.9 mol/L aluminum sulfate solution as the aluminum component, to the suspension comprising magnetite particles, and by adjusting the pH to 7.0.

The composition and preparation conditions of magnetic iron oxides 2 to 11 and magnetic iron oxides 14 to 16 are given in Table 1, and the various properties of magnetic iron oxides 2 to 11 and magnetic iron oxides 14 to 16 are given in Table 2.

Production Example of Magnetic Iron Oxide 12

Herein, 50 L of an iron sulfate aqueous solution containing 2.0 mol/L of $Fe^{2+}$ ($Fe^{2+}$: 100 moles) was prepared using ferrous sulfate. Further, 10 L of #3 liquid glass containing 0.23 mol/L of $Si^{4+}$ (corresponding to 0.23 atom % in terms of Si with respect to Fe, i.e. Si/Fe (atom %)=0.23) was prepared using #3 liquid glass. This liquid glass was added to the above iron sulfate aqueous solution. Next, a ferrous hydroxide slurry was obtained by mixing, under stirring, the mixed aqueous solution with 42 L of a 5.0 mol/L NaOH aqueous solution (corresponding to 1.05 equivalents with respect to $Fe^{2+}$, i.e. 2OH/Fe=1.05). The ferrous hydroxide slurry was adjusted to pH 12.0 and to a temperature of 90° C., and 30 L/min of air was blown into the ferrous hydroxide slurry, to perform an oxidation reaction until 50% of the ferrous hydroxide turned into magnetic iron oxide particles. Next, 20 L/min of air were blown until 75% of the ferrous hydroxide turned into magnetic iron oxide particles. Next, 10 L/min of air were blown until 90% of the ferrous hydroxide turned into magnetic iron oxide particles; at the point in time in which the proportion of the magnetic iron oxide particles exceeded 90%, further 5 L/min of air were blown, to complete thereby the oxidation reaction. A slurry comprising octahedral magnetic iron oxide core particles was thus obtained.

Further, 94 mL of an aqueous solution of sodium silicate containing 13.4 mass % of Si, plus 288 mL of an aqueous solution of aluminum sulfate containing 4.2 mass % of Al were simultaneously added to the obtained slurry comprising magnetic iron oxide core particles. Thereafter, the temperature of the slurry was adjusted to 80° C., and pH was adjusted to a range of 5.0 to 9.0, using dilute sulfuric acid, to form a coat layer comprising silicon and aluminum on the surface of the magnetic iron oxide core particles. The obtained magnetic iron oxide particles were filtered, dried and pulverized in accordance with ordinary methods, to yield magnetic iron oxide 12.

The composition and preparation conditions of magnetic iron oxide 12 are given in Table 1, and the various properties of magnetic iron oxide 12 are given in Table 2.

Production Example of Magnetic Iron Oxide 13

(First Reaction Step)

A ferrous salt suspension was prepared by mixing 16 L of a ferrous sulfate aqueous solution comprising 1.5 mol/L of $Fe^{2+}$ ($Fe^{2+}$: 24 moles) and 14.4 L of a 3.0 N sodium hydroxide solution (corresponding to 0.90 equivalents with respect to $Fe^{2+}$, i.e. 2OH/Fe=0.90), with adjustment of the pH to 9.0. Then, #3 liquid glass as a silicon component (corresponding to 0.92 atom % in terms of Si with respect to Fe, i.e. Si/Fe (atom %)=0.92) were added. The ferrous salt suspension was aerated with 70 L of air per minute, at a temperature of 90° C., to perform an oxidation reaction until the oxidation reaction rate of the ferrous salt reached 30%. A ferrous salt suspension comprising magnetite nucleus crystal particles was thus obtained.

(Second Reaction Step)

Further, 3.2 L of a 3.0 N sodium hydroxide solution (corresponding to 1.10 equivalents, together with the sodium hydroxide solution in the first reaction step, with respect to 24 moles of $Fe^{2+}$, i.e. 2OH/Fe=1.10) was added to the ferrous salt suspension containing the magnetite nucleus crystal particles, and the whole was aerated with 70 L per minute of air, at a temperature of 90° C., to complete the oxidation reaction, and yield magnetic iron oxide 13 as a result. Further, a Si and Al coat layer was formed by adding appropriate amounts, as given in Table 1, of #3 liquid glass as the silicon component and a 1.9 mol/L aluminum sulfate solution as the aluminum component, to the suspension comprising magnetite nucleus crystal particles, and by adjusting the pH to 7.0.

The composition and preparation conditions of magnetic iron oxide 13 are given in Table 1, and the various properties of magnetic iron oxide 13 are given in Table 2.

Production Example of Binder Resin (1)

| | |
|---|---|
| Bisphenol A-propylene oxide 2-mole adduct | 4000 g |
| Bisphenol A-propylene oxide 3-mole adduct | 2800 g |
| Terephthalic acid | 1200 g |
| Isophthalic acid | 1200 g |
| Tetrabutyl titanate (condensation catalyst) | 20 g |

The above materials were charged, and were left to react for 10 hours while under distillation of the generated water, in a nitrogen stream at 220° C. Next, the reaction was left to proceed under reduced pressure, ranging from 5 to 20 mmHg, the whole was cooled to 180° C. at the point in time in which the acid value became 2 mgKOH/g or lower, and 2500 g of trimellitic anhydride were added thereupon to the reaction solution. After 2 hours of reaction under sealed atmospheric pressure, the product was removed, was cooled to room temperature, and was pulverized, to yield the intended binder resin (1).

Example 1

Production Example of Magnetic Toner 1

| | |
|---|---|
| Binder resin (1) | 100 parts by mass |
| Magnetic iron oxide 1 | 50 parts by mass |
| Fischer-Tropsch wax (C105, melting point 105° C., by Sasol Wax) | 2 parts by mass |
| Charge control agent (T-77, by Hodogaya Chemical Co., Ltd.) | 2 parts by mass |

The above materials were pre-mixed in a Henschel mixer, and were melted and kneaded in a biaxial kneading extruder. The obtained kneaded product was cooled, and was coarsely pulverized using a hammer mill, followed by pulverization in a jet mill, and classification of the resulting fine pulverized powder obtained using a multi-grade classifier that relied on the Coanda effect, to yield a magnetic toner particle having negative triboelectric chargeability and having a weight-average particle diameter (D4) of 6.8 μm. Then 1.0 part by mass of a hydrophobic silica fine powder (specific surface area of 140 $m^2/g$ by nitrogen adsorption as measured according to BET), and 3.0 parts by mass of strontium titanate (volume-average particle diameter 1.6 μm) were externally added, and the whole was sifted using a mesh having a sieve opening of 150 μm, to yield magnetic toner 1 having negative triboelectric chargeability. The type and parts of the magnetic iron oxide of magnetic toner 1 are given in Table 3.

Examples 2 to 14 and Comparative Examples 1 to 5>

Production Example of Magnetic Toners 2 to 14 and Comparative Magnetic Toners 1 to 5

Magnetic toners 2 to 14 and comparative magnetic toners 1 to 5 were obtained in the same way as in Example 1, but herein the magnetic iron oxide and the parts of magnetic iron oxide were modified as set out in Table 3.

<Evaluation of Toner Carrying Member Scraping>

The outer diameter value of the toner carrying member was obtained as the average value of 30-site measurements of the outer diameter, in the longitudinal direction of the toner carrying member, using an outer diameter measurement instrument (laser sizer LS5040, by KEYENCE CORPORATION). The scraping amount of the toner carrying member was calculated as the value resulting from subtracting the outer diameter value after a durability test from the outer diameter value before use. Scraping of the toner carrying member was evaluated in accordance with the criteria below. To measure scraping after a durability test there was used a toner carrying member having undergone a 100,000-print durability test using a commercially available digital copier (iR-ADV4051, by Canon Inc.), under a high-temperature high-humidity (H/H) environment of 30° C. and 80° C. RH, in which toner carrying member scraping is conceivably more severe. The surface of the toner carrying member was washed with isopropanol for the measurement after the durability test.

(Evaluation criteria)

A: scraping amount smaller than 1.0 μm

B: scraping amount from 1.0 μm to less than 2.0 μm

C: scraping amount from 2.0 μm to less than 3.0 μm

D: scraping amount of 3.0 μm or greater

<Evaluation of Tailing>

Tailing was worked out as the ratio of line widths of longitudinal and transversal lines (longitudinal/transversal line ratio) after printing of longitudinal and transversal line images of defined latent image line width, in a low-temperature low-humidity (L/L) environment in which tailing is prone to arise. Tailing occurs along the rotation direction of the photosensitive member; accordingly, the width of transversal lines is more readily affected by tailing, and line width increases to a greater extent, than in the case of longitudinal lines. Therefore, the longitudinal/transversal line ratio becomes 1 or smaller, and it is found that tailing is suppressed to a greater degree as the value comes closer to 1. The evaluation details are explained next.

A commercially available digital copier (image RUNNER 4051, by Canon Inc.) was modified to a process speed of 252 mm/s, and images were outputted in a low-temperature, low-humidity environment (15° C., 10% RH) after respective magnetic toners had undergone long-term standing in an environment (45° C., 95% RH, one month) deemed to be more conducive to the occurrence of tailing due to aggregation. Herein, a 600 dpi patterned latent image having 10-dot longitudinal and transversal lines (latent image line width of about 420 μm) was drawn by laser exposure, at a 1 cm spacing, onto an electrostatic latent image bearing member, the image was developed, was transferred onto a PET-made OHP, and was fixed, to yield a line image as the image used for tailing evaluation. The manner in which toner was overlaid on the longitudinal and transversal lines of the obtained longitudinal-transversal line pattern image was checked, in the form of a surface roughness profile, using a surface profile analyzer SURFCORDER SE-30H (by Kosaka Laboratory Ltd.). The line widths were then worked out on the basis of the respective widths of the profiles, to calculate the longitudinal/transversal line ratio. The calculated values were evaluated according to the criteria below.

(Evaluation Criteria)

A: longitudinal/transversal line ratio of 0.90 or higher

B: longitudinal/transversal line ratio from 0.80 to less than 0.90

C: longitudinal/transversal line ratio from 0.70 to less than 0.80

D: longitudinal/transversal line ratio lower than 0.70

<Evaluation of Fogging>

Image outputting for fogging evaluation was performed using a device resulting from modifying the process speed of a commercially available digital copier (image RUNNER 4051, by Canon Inc.) to 252 mm/s. Fogging was evaluated on the basis of measurements using a reflectometer (Reflectometer Model TC-6DS, by Tokyo Denshoku CO., LTD.), taking Dr-Ds as the amount of fogging, where Ds denotes the worst value of white-background reflection density after image formation and Dr denotes reflection average density of transfer material before image formation. A smaller value of Dr-Ds entails a greater degree of fogging suppression. A second solid white image outputted in a succession of two sheets was used as the evaluation image.

(Evaluation Criteria)

A: fogging smaller than 1.0%

B: fogging from 1.0% to less than 2.0%

C: fogging from 2.0% to less than 3.0%

D: fogging of 3.0% or greater (Color Tone Measurement)

To measure color tone there were printed 100,000 copies in a normal-temperature, normal-humidity environment (23° C., 60% RH), using a device resulting from modifying the process speed of the above image RUNNER 4051 (by Canon Inc.) to 252 mm/s; thereafter, a halftone image having a toner transmission density ranging from 0.50 to 0.90, upon subtraction of the transmission density of paper, was outputted on A4 office planner paper (by Canon Marketing Japan Inc., 64 $g/m^2$). Transmission density was measured under the conditions below, using a Macbeth transmission densitometer TD904 (by Macbeth); herein transmission density was evaluated as Ts-Tr, where Ts denotes the average of the transmission densities of five points in a portion where an image is formed and Tr denotes the average of the transmission densities of five points in a transfer material before image formation.

<Measurement Conditions of the Transmission Densitometer>

Light source: halogen lamp HLX64610 (50 W/12 V, by OSRAM GmbH)

Filter: visual

In the CIE Lab coordinates, a larger positive value of a* denotes greater reddishness, while a larger negative value denotes greater greenishness. Similarly, a larger positive value of b* corresponds to yellowing, while a larger negative value entails increased bluishness. The values of chromaticity a* and b* according to a CIE Lab measurement of the above image were measured herein. Numerical values such that both chromaticity a* and b* values are small are indicative of strong blackness. The CIE Lab measurements were performed herein using a Spectrolino instrument by GretagMacbeth GmbH. The specific measurement conditions were as follows.

<Color Tone Measurement Condition>

Observation light source: D50

Field of view: 2°

Density: DIN

White reference: Abs

Filter: No (Evaluation Criteria)

A: value smaller than 0.35, b* value smaller than −0.55

B: value from 0.35 to less than 0.45, b* value from −0.55 to less than −0.45

C: value from 0.45 to less than 0.55, b* value from −0.45 to less than −0.35

D: value equal to or higher than 0.55, b* value equal to or higher than −0.35

<Image Density Evaluation>

A device resulting from modifying the process speed of a commercially available digital copier (image RUNNER 4051, by Canon Inc.) to 252 mm/s was used herein as an image-forming apparatus. Using the above apparatus, there were consecutively printed 100,000 prints in a high-temperature high-humidity environment (30° C., 80% RH), using a test chart having a print percentage of 5%. The image density after 100,000 prints was measured by measuring the reflection density of a 5-mm circular solid black image, using an SPI filter in a Macbeth densitometer (by Macbeth), which is a reflection densitometer.

The evaluation results of the above magnetic toners and comparative magnetic toners were as follows.

Magnetic toner 1 was rated A as regards all properties.

Toner carrier scraping in magnetic toners 2 and 3 was rated B. This result is found to arise from the fact that the product of the number-average particle diameter and the specific surface area of the magnetic iron oxide particle was greater than 0.95.

The magnetic toner color tone and toner carrying member scraping of magnetic toner 4 were rated B. These results are found to arise from the fact that the number-average particle diameter of the magnetic iron oxide particle was greater than 0.14 μm.

The magnetic toner color tone and toner carrying member scraping of magnetic toner 5 were rated B. These results are found to arise from the fact that the number-average particle diameter of the magnetic iron oxide particle was smaller than 0.10 μm.

Magnetic toners 6 to 8 were rated B as regards all properties. This result is found to arise from the fact that the product of the number-average particle diameter and the specific surface area of the magnetic iron oxide particle was greater than 1.00.

Tailing and fogging of magnetic toner 9 were rated C. These results are found to arise from the fact that the content of the magnetic iron oxide particle in the magnetic toner was greater than 60 parts by mass with respect to 100 parts by mass of the binder resin. Tailing and fogging of magnetic toner 10 were rated C. These results are found to arise from the fact that the content of the magnetic iron oxide particle in the magnetic toner was smaller than 30 parts by mass with respect to 100 parts by mass of the binder resin. Tailing and fogging of magnetic toner 11 were rated C. These results are found to arise from the fact that the content of the magnetic iron oxide particle in the magnetic toner was greater than 60 parts by mass with respect to 100 parts by mass of the binder resin.

The tailing, fogging and magnetic toner color tone of magnetic toners 12 and 13 were rated C, and toner carrying member scraping as B. These results are found to arise from the fact that the exothermic onset temperature was lower than 160° C.

Magnetic toner 14 was rated C as regards all properties. This result is found to arise from the fact that the proportion of the number of particles of the magnetic iron oxide having a number-average particle diameter smaller than 0.05 μm was more than 10 number % with respect to the total magnetic iron oxide particles.

The magnetic toner color tone of comparative magnetic toner 1 was rated B, and tailing, fogging and toner carrying member scraping were rated D. These results are found to arise from the fact that the product of the number-average particle diameter and the specific surface area was greater than 1.10, the proportion of the number of particles of magnetic iron oxide having a number-average particle diameter smaller than 0.05 μm was greater than 10% of the total number of the magnetic iron oxide particles, and the content of magnetic iron oxide particle in the magnetic toner was greater than 60 parts by mass with respect to 100 parts by mass of the binder resin.

The magnetic toner color tone of comparative magnetic toner 2 was rated B, and tailing, fogging and toner carrying member scraping were rated D. These results are found to arise from the fact that the product of the number-average particle diameter and the specific surface area was greater than 1.10, the proportion of the number of particles of magnetic iron oxide having a number-average particle diameter smaller than 0.05 μm was greater than 10% of the total number of the magnetic iron oxide particles, and the magnetic iron oxide particle was polyhedral in shape.

The magnetic toner color tone of comparative magnetic toner 3 was rated D, and tailing, fogging and toner carrying member scraping were rated B. These results are found to arise from the fact that the number-average particle diameter of the magnetic iron oxide particle was smaller than 0.05 μm.

The toner carrying member scraping of comparative magnetic toner 4 was rated A, but the magnetic toner color tone was rated D, and tailing and fogging were rated B. These results are found to arise from the fact that the number-average particle diameter of the magnetic iron oxide particle was larger than 0.15 μm.

Comparative magnetic toner 5 was rated D as regards all properties. This result is found to arise from the fact that the product of the number-average particle diameter and the specific surface area was greater than 1.10, the number-average particle diameter of the magnetic iron oxide particle was greater than 0.15 μm, the proportion of the number of particles of magnetic iron oxide having a number-average particle diameter smaller than 0.05 μm was greater than 10% of total number of the magnetic iron oxide particles, the content of the magnetic iron oxide particle in the magnetic toner was greater than 60 parts by mass with respect to 100 parts by mass of the binder resin, the magnetic iron oxide particle was spherical in shape, and the exothermic onset temperature was lower than 160° C.

TABLE 1

| | First-stage reaction | | | | | | | | Second-stage |
|---|---|---|---|---|---|---|---|---|---|
| | Ferrous salt | | Equivalent | Water-soluble silicate | | | Oxidation | Reaction | reaction Equivalent |
| Sample name | aqueous solution | Alkali hydroxide | ratio (2OH/Fe) | | Si/Fe (atm %) | pH | reaction rate (%) | temperature (° C.) | ratio (2OH/Fe) |
| Magnetic iron oxide 1 | Ferrous sulfate | Sodium hydroxide | 0.95 | #3 liquid glass | 0.25 | 8.5 | 10 | 90 | 1.15 |
| Magnetic iron oxide 2 | Ferrous sulfate | Sodium hydroxide | 0.94 | #3 liquid glass | 0.23 | 8.4 | 10 | 90 | 1.10 |
| Magnetic iron oxide 3 | Ferrous sulfate | Sodium hydroxide | 0.94 | #3 liquid glass | 0.24 | 8.3 | 10 | 90 | 1.05 |
| Magnetic iron oxide 4 | Ferrous sulfate | Sodium hydroxide | 0.98 | #3 liquid glass | 0.24 | 8.0 | 10 | 90 | 1.15 |
| Magnetic iron oxide 5 | Ferrous sulfate | Sodium hydroxide | 0.94 | #3 liquid glass | 0.90 | 8.7 | 9 | 90 | 1.20 |
| Magnetic iron oxide 6 | Ferrous sulfate | Sodium hydroxide | 0.98 | #3 liquid glass | 0.24 | 8.5 | 8 | 90 | 1.05 |
| Magnetic iron oxide 7 | Ferrous sulfate | Sodium hydroxide | 0.99 | #3 liquid glass | 0.24 | 8.7 | 10 | 90 | 1.15 |
| Magnetic iron oxide 8 | Ferrous sulfate | Sodium hydroxide | 0.99 | #3 liquid glass | 0.24 | 8.7 | 10 | 90 | 1.15 |
| Magnetic iron oxide 9 | Ferrous sulfate | Sodium hydroxide | 0.99 | #3 liquid glass | 0.24 | 8.7 | 10 | 90 | 1.15 |
| Magnetic iron oxide 10 | Ferrous sulfate | Sodium hydroxide | 0.95 | #3 liquid glass | 0.90 | 8.9 | 9 | 90 | 1.20 |
| Magnetic iron oxide 11 | Ferrous sulfate | Sodium hydroxide | 0.95 | #3 liquid glass | 0.89 | 9.0 | 10 | 90 | 1.20 |
| Magnetic iron oxide 12 | Ferrous sulfate | Sodium hydroxide | 1.05 | #3 liquid glass | 0.23 | 12.0 | 100 | 90 | — |
| Magnetic iron oxide 13 | Ferrous sulfate | Sodium hydroxide | 0.90 | #3 liquid glass | 0.92 | 9.0 | 30 | 90 | 1.10 |
| Magnetic iron oxide 14 | Ferrous sulfate | Sodium hydroxide | 0.98 | #3 liquid glass | 0.95 | 9.0 | 10 | 90 | 1.20 |
| Magnetic iron oxide 15 | Ferrous sulfate | Sodium hydroxide | 0.95 | #3 liquid glass | 0.57 | 8.6 | 12 | 90 | 1.15 |
| Magnetic iron oxide 16 | Ferrous sulfate | Sodium hydroxide | 1.04 | — | — | 6.0~8.0 | 30 | 80 | 1.05 |

| | Second-stage reaction | | | Third-stage reaction | | | | |
|---|---|---|---|---|---|---|---|---|
| | | | | | | Water-soluble silicate | | Reaction |
| Sample name | Oxidation reaction rate (%) | Reaction temperature (° C.) | Relay condition pH | Alkali hydroxide | pH | | Si/Fe (atm %) | temperature (° C.) |
| Magnetic iron oxide 1 | 50 | 90 | 7.5 | Sodium hydroxide | 10.5 | #3 liquid glass | 0.40 | 90 |
| Magnetic iron oxide 2 | 55 | 90 | 8.0 | Sodium hydroxide | 10.5 | #3 liquid glass | 0.40 | 90 |
| Magnetic iron oxide 3 | 51 | 90 | 7.6 | Sodium hydroxide | 10.0 | #3 liquid glass | 0.40 | 90 |
| Magnetic iron oxide 4 | 52 | 90 | 7.2 | Sodium hydroxide | 10.0 | #3 liquid glass | 0.39 | 90 |
| Magnetic iron oxide 5 | 51 | 90 | 8.6 | Sodium hydroxide | 10.3 | #3 liquid glass | 0.39 | 90 |
| Magnetic iron oxide 6 | 57 | 90 | 8.1 | Sodium hydroxide | 10.3 | #3 liquid glass | 0.39 | 90 |
| Magnetic iron oxide 7 | 60 | 90 | 8.5 | Sodium hydroxide | 10.5 | #3 liquid glass | 0.24 | 90 |
| Magnetic iron oxide 8 | 60 | 90 | 8.5 | Sodium hydroxide | 10.5 | #3 liquid glass | 0.24 | 90 |
| Magnetic iron oxide 9 | 60 | 90 | 8.5 | Sodium hydroxide | 10.5 | #3 liquid glass | 0.24 | 90 |
| Magnetic iron oxide 10 | 50 | 90 | 8.3 | Sodium hydroxide | 10.3 | #3 liquid glass | 0.39 | 90 |
| Magnetic iron oxide 11 | 50 | 90 | 8.6 | Sodium hydroxide | 10.3 | #3 liquid glass | 0.39 | 90 |
| Magnetic iron oxide 12 | — | — | — | — | — | — | — | — |
| Magnetic iron oxide 13 | 100 | 90 | — | — | — | — | — | — |
| Magnetic iron oxide 14 | 50 | 90 | 8.6 | Sodium hydroxide | 10.3 | #3 liquid glass | 0.39 | 90 |
| Magnetic iron oxide 15 | 55 | 90 | 8.0 | Sodium hydroxide | 10.5 | #3 liquid glass | 0.39 | 90 |

TABLE 1-continued

| | | | | | | | | |
|---|---|---|---|---|---|---|---|---|
| Magnetic iron oxide 16 | 60 | 80 | 6.0~8.0 | Sodium hydroxide | 6.0~8.0 | #3 liquid glass | 0.44 | 80 |

TABLE 2

| Sample name | Number-average particle diameter (μm) | Specific surface area ($m^2/g$) | Number-average particle diameter × specific surface area [Expression (1)] | Proportion (%) of magnetic iron oxide smaller than 0.05 μm | Particle shape | Exothermic onset temperature (° C.) | Si content Si/Fe (atm %) | Surface Si content Si/Fe (atm %) | Surface Al content Al/Fe (atm %) | Si dissolution rate (%) at 10% iron dissolution rate |
|---|---|---|---|---|---|---|---|---|---|---|
| Magnetic iron oxide 1 | 0.12 | 7.9 | 0.95 | 6 | Octahedral | 182 | 1.22 | 0.57 | 0.86 | 64.8 |
| Magnetic iron oxide 2 | 0.14 | 6.8 | 0.97 | 5 | Octahedral | 183 | 1.20 | 0.57 | 0.86 | 35.4 |
| Magnetic iron oxide 3 | 0.10 | 1.0 | 0.99 | 7 | Octahedral | 180 | 1.21 | 0.57 | 0.86 | 34.1 |
| Magnetic iron oxide 4 | 0.15 | 6.4 | 0.96 | 2 | Octahedral | 183 | 1.20 | 0.57 | 0.86 | 30.6 |
| Magnetic iron oxide 5 | 0.05 | 20.0 | 1.00 | 9 | Octahedral | 165 | 1.86 | 0.57 | 0.86 | 39.9 |
| Magnetic iron oxide 6 | 0.15 | 6.8 | 1.02 | 3 | Octahedral | 183 | 1.20 | 0.57 | 0.86 | 32.3 |
| Magnetic iron oxide 7 | 0.15 | 7.3 | 1.10 | 5 | Octahedral | 180 | 1.05 | 0.57 | 0.86 | 25.5 |
| Magnetic iron oxide 8 | 0.15 | 7.3 | 1.10 | 5 | Octahedral | 160 | 0.86 | 0.38 | 0.43 | 25.5 |
| Magnetic iron oxide 9 | 0.15 | 7.3 | 1.10 | 5 | Octahedral | 158 | 0.83 | 0.35 | 0.21 | 25.5 |
| Magnetic iron oxide 10 | 0.05 | 20.5 | 1.03 | 10 | Octahedral | 158 | 1.77 | 0.48 | 0.43 | 39.9 |
| Magnetic iron oxide 11 | 0.05 | 22.0 | 1.10 | 11 | Octahedral | 154 | 1.76 | 0.48 | 0.43 | 39.9 |
| Magnetic iron oxide 12 | 0.14 | 8.9 | 1.25 | 13 | Octahedral | 170 | 0.43 | 0.20 | 0.19 | 11.3 |
| Magnetic iron oxide 13 | 0.15 | 7.9 | 1.19 | 11 | Polyhedral | 178 | 1.30 | 0.38 | 0.86 | 50.3 |
| Magnetic iron oxide 14 | 0.04 | 27.0 | 1.08 | 10 | Octahedral | 160 | 1.74 | 0.40 | 0.86 | 39.9 |
| Magnetic iron oxide 15 | 0.16 | 6.8 | 1.09 | 10 | Octahedral | 165 | 1.15 | 0.19 | 0.86 | 25.5 |
| Magnetic iron oxide 16 | 0.20 | 7.0 | 1.40 | 15 | Spherical | 150 | 0.64 | 0.20 | 0.20 | 48.4 |

| | $X_{20-40}$ | | | $X_{40-60}$ | | | $X_{60-80}$ | | |
|---|---|---|---|---|---|---|---|---|---|
| Sample name | Iron dissolution rate (%) | Si dissolution rate specified range ($Y_{20-40}$) | Si dissolution rate (%) | Iron dissolution rate (%) | Si dissolution rate specified range ($Y_{40-60}$) | Si dissolution rate (%) | Iron dissolution rate (%) | Si dissolution rate specified range ($Y_{60-80}$) | Si dissolution rate (%) |
| Magnetic iron oxide 1 | 30.8 | 69.4~76.6 | 70.1 | 52.8 | 78.0~85.1 | 80.2 | 71.1 | 85.2~92.2 | 86.1 |
| Magnetic iron oxide 2 | 30.2 | 43.4~56.4 | 48.4 | 53.4 | 60.1~73.0 | 66.1 | 70.8 | 72.6~85.5 | 76.5 |
| Magnetic iron oxide 3 | 30.4 | 42.4~55.6 | 48.6 | 55.1 | 60.5~73.7 | 63.2 | 73.1 | 73.7~86.9 | 78.2 |
| Magnetic iron oxide 4 | 30.5 | 39.5~53.3 | 47.8 | 50.9 | 55.2~59.1 | 58.9 | 71.6 | 71.2~85.0 | 73.1 |
| Magnetic iron oxide 5 | 29.8 | 47.1~59.1 | 55.1 | 50.1 | 60.7~72.7 | 67.9 | 70.3 | 74.2~86.2 | 80.1 |
| Magnetic iron oxide 6 | 30.7 | 41.1~54.6 | 48.3 | 52.2 | 57.3~70.8 | 62.1 | 70.6 | 71.1~84.7 | 73.3 |
| Magnetic iron oxide 7 | 21.1 | 27.2~42.1 | 35.1 | 40.6 | 43.4~58.3 | 50.3 | 60.4 | 59.8~74.7 | 63.5 |
| Magnetic iron oxide 8 | 21.1 | 27.2~42.1 | 35.1 | 40.6 | 43.4~58.3 | 50.3 | 60.4 | 59.8~74.7 | 63.5 |
| Magnetic iron oxide 9 | 21.1 | 27.2~42.1 | 35.1 | 40.6 | 43.4~58.3 | 50.3 | 60.4 | 59.8~74.7 | 63.5 |
| Magnetic iron oxide 10 | 29.8 | 47.1~59.1 | 55.1 | 50.1 | 60.7~72.7 | 67.9 | 70.5 | 74.2~86.2 | 80.3 |

TABLE 2-continued

| | | | | | | | | | |
|---|---|---|---|---|---|---|---|---|---|
| Magnetic iron oxide 11 | 29.8 | 47.1~59.1 | 55.1 | 50.1 | 60.7~72.7 | 67.9 | 70.6 | 74.2~86.2 | 80.4 |
| Magnetic iron oxide 12 | 30.8 | 22.9~40.6 | 18.5 | 54.6 | 46.4~64.1 | 38.7 | 70.7 | 62.2~80.0 | 57.3 |
| Magnetic iron oxide 13 | 30.3 | 56.6~66.5 | 56.5 | 52.1 | 68.6~78.5 | 62.6 | 69.9 | 78.4~88.4 | 76.1 |
| Magnetic iron oxide 14 | 29.8 | 47.1~59.1 | 55.1 | 50.1 | 60.7~72.7 | 67.9 | 70.3 | 74.2~86.2 | 84.1 |
| Magnetic iron oxide 15 | 21.1 | 27.2~42.1 | 35.1 | 40.6 | 43.4~58.3 | 50.3 | 60.4 | 59.8~74.7 | 72.3 |
| Magnetic iron oxide 16 | 27 | 53.0~63.3 | 50.2 | 52.1 | 67.4~77.7 | 78.1 | 71.3 | 78.4~88.7 | 85.4 |

TABLE 3

| | Toner | Magnetic iron oxide | Parts |
|---|---|---|---|
| Example 1 | Magnetic toner 1 | Magnetic iron oxide 1 | 50 |
| Example 2 | Magnetic toner 2 | Magnetic iron oxide 2 | 50 |
| Example 3 | Magnetic toner 3 | Magnetic iron oxide 3 | 50 |
| Example 4 | Magnetic toner 4 | Magnetic iron oxide 4 | 50 |
| Example 5 | Magnetic toner 5 | Magnetic iron oxide 5 | 50 |
| Example 6 | Magnetic toner 6 | Magnetic iron oxide 6 | 50 |
| Example 7 | Magnetic toner 7 | Magnetic iron oxide 7 | 60 |
| Example 8 | Magnetic toner 8 | Magnetic iron oxide 7 | 30 |
| Example 9 | Magnetic toner 9 | Magnetic iron oxide 7 | 75 |
| Example 10 | Magnetic toner 10 | Magnetic iron oxide 7 | 25 |
| Example 11 | Magnetic toner 11 | Magnetic iron oxide 8 | 75 |
| Example 12 | Magnetic toner 12 | Magnetic iron oxide 9 | 75 |
| Example 13 | Magnetic toner 13 | Magnetic iron oxide 10 | 75 |
| Example 14 | Magnetic toner 14 | Magnetic iron oxide 11 | 75 |
| Comparative example 1 | Comparative magnetic toner 1 | Magnetic iron oxide 12 | 75 |
| Comparative example 2 | Comparative magnetic toner 2 | Magnetic iron oxide 13 | 50 |
| Comparative example 3 | Comparative magnetic toner 3 | Magnetic iron oxide 14 | 50 |
| Comparative example 4 | Comparative magnetic toner 4 | Magnetic iron oxide 15 | 50 |
| Comparative example 5 | Comparative magnetic toner 5 | Magnetic iron oxide 16 | 90 |

TABLE 4

| | Toner | Image density | Tailing | Fogging | Magnetic toner color tone | Toner carrying member scraping |
|---|---|---|---|---|---|---|
| Example 1 | Magnetic toner 1 | 1.48 | A | A | A | A |
| Example 2 | Magnetic toner 2 | 1.46 | A | A | A | B |
| Example 3 | Magnetic toner 3 | 1.43 | A | A | A | B |
| Example 4 | Magnetic toner 4 | 1.40 | A | A | B | B |
| Example 5 | Magnetic toner 5 | 1.39 | A | A | B | B |
| Example 6 | Magnetic toner 6 | 1.37 | B | B | B | B |
| Example 7 | Magnetic toner 7 | 1.37 | B | B | B | B |
| Example 8 | Magnetic toner 8 | 1.35 | B | B | B | B |
| Example 9 | Magnetic toner 9 | 1.35 | C | C | B | B |
| Example 10 | Magnetic toner 10 | 1.32 | C | C | B | B |
| Example 11 | Magnetic toner 11 | 1.31 | C | C | B | B |
| Example 12 | Magnetic toner 12 | 1.30 | C | C | C | B |
| Example 13 | Magnetic toner 13 | 1.29 | C | C | C | B |
| Example 14 | Magnetic toner 14 | 1.28 | C | C | C | C |
| Comparative example 1 | Comparative magnetic toner 1 | 1.30 | D | D | B | D |
| Comparative example 2 | Comparative magnetic toner 2 | 1.15 | D | D | B | D |
| Comparative example 3 | Comparative magnetic toner 3 | 1.08 | B | B | D | B |
| Comparative example 4 | Comparative magnetic toner 4 | 1.05 | B | B | D | A |
| Comparative example 5 | Comparative magnetic toner 5 | 1.00 | D | D | D | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-146596, filed Jul. 12, 2013, which is hereby incorporated by reference herein in its entirety.

What is claimed is:

1. A magnetic toner comprising:

a magnetic toner particle that contains:

a binder resin; and a coated magnetic iron oxide particle, the coated magnetic iron oxide particle being coated with a silicon compound and an aluminum compound, and having number-average particle diameter ranging from 0.05 μm to 0.15 μm, wherein a relationship between the number-average particle diameter (μm) of the coated magnetic iron oxide particle and the specific surface area ($m^2/g$) of the coated magnetic iron oxide particle, satisfies Expression (1) below:

$$[\text{number-average particle diameter}(\mu m)]\times[\text{specific surface area}(m^2/g)]\leq 1.00(\mu m\cdot m^2/g) \quad (1),$$

the proportion of the coated magnetic iron oxide particle having a particle diameter smaller than 0.05 μm is not more than 10 number % with respect to the total coated magnetic iron oxide particles, and the shape of the coated magnetic iron oxide particle is octahedral.

2. The magnetic toner according to claim 1, wherein the coated magnetic iron oxide particle number-average particle diameter ranges from 0.10 μm to 0.14 μm.

3. The magnetic toner according to claim 1, wherein the magnetic toner contains the coated magnetic iron oxide particle ranging from 30 parts by mass to 100 parts by mass with respect to 100 parts by mass of the binder resin contained in the magnetic toner.

4. The magnetic toner according to claim 1, wherein the magnetic toner contains the coated magnetic iron oxide particle ranging from 30 parts by mass to 60 parts by mass with respect to 100 parts by mass of the binder resin contained in the magnetic toner.

5. The magnetic toner according to claim 1, wherein the coated magnetic iron oxide particle contains silicon atoms in an amount ranging from 0.19 atom % to 1.90 atom % with respect to iron atoms.

6. The magnetic toner according to claim 1, wherein the exothermic onset temperature of the coated magnetic iron oxide particle is at least 160° C.

7. The magnetic toner according to claim 1, wherein an amount of silicon atoms in the surface of the coated magnetic iron oxide particle ranges from 0.35 atom % to 0.57 atom % with respect to iron atoms therein, and an amount of aluminum atoms in the surface of the coated magnetic iron oxide particle ranges from 0.21 atom % to 0.86 atom % with respect to iron atoms therein.

* * * * *